US007614264B2

(12) United States Patent
Mc Gettrick

(10) Patent No.: US 7,614,264 B2
(45) Date of Patent: Nov. 10, 2009

(54) SECURE, DETACHABLY ANCHORED LOCK SYSTEMS

(76) Inventor: John M. Mc Gettrick, 26875 Calle Hermosa, Suite 3, Capistrano Beach, CA (US) 92624

( * ) Notice: Subject to any disclaimer, the term of this patent is extended or adjusted under 35 U.S.C. 154(b) by 0 days.

(21) Appl. No.: 10/778,506

(22) Filed: Feb. 13, 2004

(65) Prior Publication Data

US 2005/0178172 A1 Aug. 18, 2005

(51) Int. Cl.
*E05B 73/00* (2006.01)

(52) U.S. Cl. ..... 70/14; 70/49; 70/58; 70/232; 70/DIG. 57; 248/553; 411/910

(58) Field of Classification Search ..... 70/232, 70/DIG. 57, 58, 14, 18, 30, 49, 38 A, 229–231; 248/551–553; 411/910
See application file for complete search history.

(56) References Cited

U.S. PATENT DOCUMENTS

| | | | | | |
|---|---|---|---|---|---|
| 1,618,997 | A | * | 3/1927 | Radandt | 70/260 |
| 3,211,408 | A | | 10/1965 | Schaefer | |
| 3,559,429 | A | * | 2/1971 | Hermann | 70/85 |
| 3,625,031 | A | * | 12/1971 | Alley | 70/58 |
| 3,631,896 | A | * | 1/1972 | Meigs | 138/89 |
| 3,765,197 | A | | 10/1973 | Foote | |
| 3,859,826 | A | | 1/1975 | Singer | |
| 3,990,276 | A | * | 11/1976 | Shontz | 70/58 |
| 4,033,160 | A | * | 7/1977 | Mima | 70/233 |
| 4,055,973 | A | * | 11/1977 | Best | 70/58 |
| 4,065,946 | A | * | 1/1978 | Loynes et al. | 70/58 |
| 4,212,175 | A | | 7/1980 | Zakow | |
| 4,324,119 | A | | 4/1982 | Mitton | |
| 4,339,629 | A | * | 7/1982 | Stanmore | 174/50 |
| 4,340,376 | A | * | 7/1982 | Williams | 441/74 |
| 4,444,031 | A | * | 4/1984 | Watson | 70/232 |
| 5,152,160 | A | * | 10/1992 | Lentini | 70/51 |
| 5,179,848 | A | * | 1/1993 | Kief | 70/51 |
| 5,351,507 | A | * | 10/1994 | Derman | 70/18 |
| 5,408,212 | A | * | 4/1995 | Meyers et al. | 340/427 |
| 5,447,045 | A | * | 9/1995 | Cheng | 70/58 |
| 5,709,110 | A | * | 1/1998 | Greenfield et al. | 70/58 |
| 5,794,463 | A | * | 8/1998 | McDaid | 70/18 |
| 5,794,465 | A | * | 8/1998 | Hill | 70/63 |

(Continued)

FOREIGN PATENT DOCUMENTS

FR 927017 * 10/1947

(Continued)

*Primary Examiner*—Lloyd A Gall
(74) *Attorney, Agent, or Firm*—BioTechnology Law Group; Daniel M. Chambers

(57) ABSTRACT

The present invention provides new anchored lock systems wherein the locking device (e.g., a padlock) can be rapidly detached from its anchor. The systems comprise an anchor for attachment to a structure such as a wall, portable panel, etc., or a structure a portion of which has been adapted to detachably engage the locking device. The anchor can be mounted in any desired location on a structure, and is configured such that it can be engaged by the lock body of a locking device that comprises at least two locking functionalities: releasable engagement of the anchor to prevent the locking device from being removed from the anchor when engaged by the lock; and releasable engagement of a shackle for retention of an article to be secured.

17 Claims, 13 Drawing Sheets

U.S. PATENT DOCUMENTS 5,889,463 A * 3/1999 Judd et al. ..... 340/427
6,349,575 B1 * 2/2002 Bentley ..... 70/18
6,474,122 B2 * 11/2002 Davis ..... 70/278.3
6,622,532 B2 9/2003 Hsu
7,048,246 B2 * 5/2006 Leyden et al. ..... 248/551
2005/0204786 A1 * 9/2005 Meyer et al. ..... 70/58
2006/0225470 A1 * 10/2006 Avganim ..... 70/58

FOREIGN PATENT DOCUMENTS

GB 959271 * 5/1964

* cited by examiner 66
52
82
50
A
66
52
60
90
80
50
32
92
B
66
86
52
50
70
72
70
C

SECURE, DETACHABLY ANCHORED LOCK SYSTEMS

FIELD OF THE INVENTION

The present invention relates generally to locks, and more particularly to locks that can be temporarily anchored in a secure fashion.

BACKGROUND OF THE INVENTION

1. Introduction

The following description includes information that may be useful in understanding the present invention. It is not an admission that any such information is prior art, or relevant, to the presently claimed inventions, or that any publication specifically or implicitly referenced is prior art.

2. Background

A vast number of lock designs are known, including padlocks, for securing articles. Padlocks are detachable, portable locks having a shackle that locks into the lock case or body. The lock case contains a lock mechanism that releasably engages a movable shackle. In many cases, the shackle is U-shaped, with two substantially parallel arms each being connected at one end to a curved or straight joining portion that connects one arm to the other. The other end of each arm engages the lock. When the lock is unlocked, the shackle can be moved. Depending on the lock design, the shackle may be removed totally from the lock body when the locked is unlocked, or, alternatively, the shackle may be pulled outward from the body and rotated such that a longer arm of the shackle remains retained in the lock body while the other arm disengages from the body such that it can be passed through an opening in an article or otherwise engage the article(s) to be secured. In order for the shackle to be lockably engaged and retained by the lock, the shackle is inserted into the lock body and a locking element (e.g., a notch or other element suitable for detachable engagement) near the end of the formerly disengaged shackle arm is engaged, frequently by locking a ball into a notch (or other element). In some padlock designs that employ a multi-armed shackle, each arm has a locking element that can be engaged by a ball or other arm-retaining structure.

Some conventional padlock applications involve permanently fastening a padlock to a structure so that the lock can be used to retain articles. For example, some motorcycle helmet locks employ a padlock bolted or welded to a motorcycle frame. A helmet can then be locked to the motorcycle using the padlock, freeing the rider from having to carry or store the helmet elsewhere. However, when not in use the padlock cannot be easily removed. This represents a major shortcoming of systems that employ padlocks that are bolted, welded, or otherwise permanently attached to an object other the article being secured.

The instant invention addresses these and other shortcomings of existing padlock-based systems for anchoring articles to various structures.

3. Definitions

Before describing the instant invention in detail, several terms used in the context of the present invention will be defined. In addition to these terms, others are defined elsewhere in the specification, as necessary. Unless otherwise expressly defined herein, terms of art used in this specification will have their art-recognized meanings.

A "lock" refers to any device that prevents access or use by requiring special knowledge (e.g., a combination) or a tool (e.g., a key or card) or information (e.g., an "unlock" command transmitted via a radio frequency). Preferred locks for use in the invention include cam locks and cylinder locks. A "cam lock" is a complete locking assembly in the form of a cylinder whose cam is the actual locking bolt, wherein a "cam" is a lock or cylinder component that transfers the rotational motion of a key or cylinder plug to the bolt-works of a lock. As described above, a "padlock" has a lock that detachably secures a shackle (i.e. the part of a padlock that passes through an opening in, or fits around, an object to be secured) that locks into the lock case or body. The lock portion can be opened using the appropriate tool (e.g., key or card), combination, or signal configured to actuate the lock.

A "combination lock" means a lock that can be opened or unlocked by local input of a specific series or sequence of numbers, letters, and/or other characters or other icons. A "push button lock" is a type of self-contained combination lock with controls that must be pressed in a specific pattern or sequence to open the lock. On the other hand, a "key-actuated lock" is a lock that can be opened or unlocked using a mechanical key (i.e., a properly combinated device which is, or most closely resembles, the device specifically intended to operate the corresponding lock), as opposed to a combination, electronics, etc. A "cylinder key" refers generally to virtually all keys for pin and disc tumbler locks, in that the key is intended for insertion into a cylinder. Thus, a "cylinder lock" is any lock that is operated by a cylinder key.

A lock "cylinder" refers to a complete operating unit that usually consists of the shell, tumblers, springs, plug, plug retainer, a cam/tailpiece or other actuating device, and all other necessary operating parts needed to detachably engage a shackle. A "shell" is the part of the cylinder that surrounds the plug and which usually contains tumbler chambers corresponding to those in the plug. A "plug" is the part of a cylinder rotably disposed in the shell, and which contains the keyway and tumbler chambers usually corresponding to those in the cylinder shell. A "tumbler" is a movable obstruction of varying size and configuration in a lock or cylinder that makes direct contact with the key or another tumbler and prevents an incorrect key or torque device from activating the lock or other mechanism. Tumblers include pin tumblers and disc or wafer tumblers. A "pin tumbler" is usually a cylindrically shaped tumbler. Many pin tumbler locks have a single row of pins aligned with the keyway. A special type of cylinder is a cylinder for a tubular key. A "tubular key cylinder" is a cylinder whose tumblers are positioned around the circumference of the cylinder plug, as opposed to being positioned in a row aligned with the keyway. A tubular key cylinder is operated by a tubular key, i.e., a key with a tubular blade wherein the key cuts are made into the end of the blade, around its circumference. A "disc tumbler" or "wafer tumbler" is a flat tumbler that must be drawn into the plug by the proper key so that none of its extremities extends into the shell. The "shear line" refers to the interface in a cylinder at which specific tumbler surfaces must be aligned in the shell and in the plug in order to remove obstruction(s) (e.g., pins) that prevent the plug from moving (e.g., rotating).

A "double lock" is a lock with one or more bolts with different functions. In the context of a lock, a "bolt" is any movable projection that blocks the movement of one object relative to another. In embodiments with two or more bolts, a single action may cause each bolt to move or, alternatively, each bolt may require a separate action (e.g., further rotation of the same key). A "gang lock" is a lock with multiple bolts that lock different elements (e.g., shackles, etc.) simultaneously by a single action.

A "power lock" refers to a lock that requires the input of energy (typically electricity of a specified voltage, current, and waveform) for lock actuation. In this context, a solenoid, servo, or other electromechanical device that moves a bolt, rotates a cylinder, etc. of the particular lock being actuated performs "lock actuation". As with lock types in general, many different power locks exist, and any power lock can be readily adapted for use in the context of this invention.

A "single cylinder lock" is one with key operation from only one side, whereas as a "double cylinder lock" is a lock with two keyed cylinders, which may be configured in a variety of ways. For example, the cylinders may be stacked or otherwise arrayed side-by-side such that the key hole for each lock are on the same side of the lock device. In other embodiments, the cylinders are aligned a central axis in a back-to-back manner such that the keyholes are on opposite ends of the lock device. Many other multi-cylinder configurations can also be employed to achieve the lock functionalities of the invention (engaging a shackle and an anchor).

A "bi-directional cylinder" is a cylinder that may be operated in a clockwise and counterclockwise direction by a single key. In contrast, a "unidirectional cylinder" is a cylinder whose key can turn in only one direction from the key pull position. A "dual locking cylinder" is a style of lock cylinder whose key operates two independent locking mechanisms within the cylinder.

A "locking device" is any device that provides the locking functionalities of the invention.

A "lock body" or "lock case" refers to a housing that houses the lock(s) of a locking device according to the invention, including any mechanical and/or electromechanical components (e.g., receivers).

A "card reader" is a device used in conjunction with a power lock or other access control system to interpret coding resident on or in an electronic, magnetic, electro-magnetic, radio frequency ("RF"), or optical type of credential (i.e., an authorizing instrument or signal, other than a mechanical key, that can cause a lock to open). Such credentials include magnetic or electronic cards or RF identity cards, including so-called "smart" cards, which contain one or more integrated circuits, do not use contacts to obtain power, and allow interfacing with external equipment (e.g., card readers). A "card system" refers a lock system that utilizes cards and card readers as the credential (or key) to open locks.

"Conceals", "conceal", and similar terms mean that the object referred to as being concealed (e.g., an anchor) is at least partially physically inaccessible. Thus, an "anchor" is concealed when it cannot be accessed due the presence of a locking device of the invention. The degree of concealment is relative. An object is "completely concealed" when no portion of it is visible or accessible due the presence of another object. An object is "substantially concealed" when it cannot be accessed due the presence of one or more other objects, although a portion of it may be visible.

"Detachable", "detachably engaging", "detachably engaged", and the similar terms mean that the object that is detachable in the context of the invention (e.g., a shackle, a lock body, etc.) can readily be removed from another object (e.g., a lock, in the case of a shackle; a lock body, in the case of an anchor, etc.) by unlocking that portion of a lock which provides the locking function being unlocked.

"Electronic access control systems" employ locks that use electricity, for example, to power actuators to move lock cylinders between locked and unlocked positions, as well as to power card readers and other receivers for receiving lock control signals, including signals transmitted by short range radio frequency (RF), infrared (IR), laser, microwave, and other forms of wireless transmission.

A "mechanical system" refers to a lock system employing a series of moving, interconnected moving parts, whereas "electromechanical systems" are lock systems that employ both mechanical (including hydraulic and pneumatic) and electrical components and moving parts that are operably connected. An "electronic system" refers to a lock system having no moving parts.

A "receiver" is an electronic device capable of receiving a control signal and, if appropriate, sending instructions for the automated operation of a device (e.g., a power lock) connected thereto. If the signal is encoded or encrypted, the receiver is configured to decode it. As used herein, a receiver is understood to include any required antennae, as well as a suitable power supply (which may depend on lock system configuration) and computer, microprocessor, software, or other devices or components required to implement command signals received by the receiver.

A "signal" refers to any signal that can be transmitted remotely to actuate a power lock. Signals are received by receivers adapted to receive and analyze the particular type of signal. Signals include sound, electromagnetic radiation (e.g., visible or infrared light, radio waves, etc.), and magnetic signals. Here, "remotely" indicates that the transmitter that transmits the signal is not physically attached to or connected with the receiver. A "transmitter" is a device that transmits a particular signal. Signals may be encoded (i.e., encrypted) or naked. Encoded signals require decoding or decryption after their receipt by a receiver. Only decoded signals carrying the correct information result in the dispatch of instructions for the automated operation of a device (e.g., a power lock) connected thereto. Naked signals do not require decoding or decryption, such that receipt of the signal alone by the receiver results in the dispatch of instructions for the automated operation of a device (e.g., a power lock) connected thereto.

To "unlock" or "open" a lock means to place the lock in a condition where it no longer performs a locking function. For example, in the context of a cam lock, unlocking the lock often means that the cam is moved to a position that no longer serves to prevent movement of the object that the cam engaged when it was locked. Similarly, to unlock a lock that engages a shackle, when locked, means that after unlocking, the shackle can be, for example, withdrawn from the lock.

A "ward" typically refers to a stationary obstruction in a lock (or cylinder of a lock) that prevents the entry and/or operation of an incorrect key. A "warded key" is a key with ward cuts only, typically a bit key, flat steel key, or corrugated key. A "keyway" is a slot in the cylinder of a cylinder lock for insertion of a key. A keyway may include one or more wards.

An "anchor" serves to secure a locking device of the invention to a structure. Anchors can comprise one, two, or several pieces. In some contexts, an "anchor" also refers to that portion a structure which may be adapted for direct interaction with a locking device according to the invention in order to effect detachable engagement, without the need for a separate anchor component attached to the structure.

A "flange" refers to that part of an anchor some or all of which engages a portion of the lock body (i.e., the lock-engaging element(s)) so as to prevent the locking device from being detached or disengaged from the anchor, typically by pulling or sliding the locking device away from or off of the anchor. The "excluded volume" of a flange (or anchor) refers to that volume defined by its outermost surfaces without reference to recesses, cavities, bores, etc.

A "structure" refers to anything to which the anchor component of a detachable lock system according to the invention can be attached. Representative examples of structures include buildings, walls, portable structures (such as panels that can be moved), and vehicles (e.g., trucks, cars, and motorcycles). For purposes of this invention, structures also include rocks, trees, and the ground (e.g., sand, soil, concrete, asphalt, etc.).

A "patentable" composition, process, machine, or article of manufacture according to the invention means that the particular subject matter satisfies all statutory requirements for patentability at the time the analysis is performed. For example, with regard to novelty, non-obviousness, or the like, if later investigation reveals that one or more claims encompass one or more embodiments that would negate novelty, non-obviousness, etc., the claim(s), being limited by definition to "patentable" embodiments, specifically exclude the unpatentable embodiment(s). Also, the claims appended hereto are to be interpreted both to provide the broadest reasonable scope, as well as to preserve their validity. Furthermore, if one or more of the statutory requirements for patentability are amended or if the standards change for assessing whether a particular statutory requirement for patentability is satisfied from the time this application issues as a patent to a time the validity of one or more of the appended claims is questioned, the claims are to be interpreted in a way that (1) preserves their validity and (2) provides the broadest reasonable interpretation under the circumstances.

SUMMARY OF THE INVENTION

The object of the invention is to provide rapidly detachable yet secure, anchored lock-based systems for securing articles.

In a first aspect then, the invention relates to locking devices (e.g., padlocks) that comprise one or more locks housed in a lock body that can detachably engage and be retained by an anchor affixed to a structure. The lock(s) of such locking devices serve at least two functions: to detachably engage a shackle that can be attached to an object to be secured; and to detachably engage an anchor in a manner that prevents the locking device, once engaged with the anchor, from being disengaged from the anchor while the lock is locked. When the lock body of the locking device engages the anchor to detachably attach the locking device to the structure, the anchor is at least partially, and preferably is substantially or completely, concealed by the locking device.

In some embodiments, to engage the anchor the lock body of the locking device has one or more ports into which the anchor (or a portion thereof) can be inserted. The manner of engaging the anchor ultimately depends on the particular configuration of the anchor and complementary port(s) on the lock body. In many preferred embodiments, the anchor is engaged by sliding the locking device over some or all of the anchor after the anchor has been affixed to a structure. In other embodiments, the locking device is placed over the anchor and twisted to mate the anchor-engaging elements of the lock body with the flange portion of the anchor that is adapted to engage the anchor-engaging portions of the lock body.

In other embodiments, the lock body of a locking device according to the invention comprises a structure adapted for insertion into a cavity in an anchor adapted to receive the structure. Preferred structures are posts that protrude from the surface of the locking device that faces the anchor when the two are detachably engaged. The post may be configured to engage one or more structurally complementary elements (e.g., one or more flanges) in the cavity of the anchor. Alternatively, the post may be configured to adopt a friction-based engagement of the anchor. In some embodiments, operation of the anchor-engaging function of the lock forces one or more portions of the post outward to engage one or mores surface in the cavity. In still other embodiments, one or more pins may be driven from the post to engage complementary bores, slots, and the like in the anchor to effect detachable engagement.

In addition to a port or other structure configured to engage an anchor (preferably some or all of the flange portion of an anchor), the lock body also contains at one or more ports for the shackle. Typically, the lock body will comprise a number of such shackle ports equal to the number of arms of the intended shackle. Thus, in embodiments where the shackle-engaging lock of the locking device is designed to engage a shackle having two arms, the lock body preferably has two shackle ports. Of course, a locking device may include more shackle ports than the number of arms of a single shackle designed for retention by a single lock, in which event the locking device can be use to secure more than one shackle. Such embodiments include those employing more than one lock for shackles. Whether the shackle-engaging locks of such devices may be opened using the same key, combination, credential or signal is left to the discretion of the skilled artisan and will depend, for example, on the intended application.

Shackles used in connection with the invention can be made from any suitable material, including flexible cables and cast or forged pieces. Regardless of the particular shackle configuration, the end(s) of the shackle are adapted for releasable engagement by the particular lock used in the locking device for engaging the particular shackle.

In addition to ports for anchors and shackles, the lock bodies of lock devices of the invention may further comprise more ports, particularly when a lock housed within the lock body is manually actuated, for example, using a key or combination. Even in embodiments that employ power locks, the components of are preferably completely concealed within the housing, a lock body may comprise a port for accessing, for example, the keyway of a cylinder lock. Any such port is configured to allow operation of the corresponding lock.

The locks used in the locking devices of the invention can be mechanical systems electromechanical systems, or electronic systems. Preferred locks include cylinder locks and combination locks, which may be actuated mechanically or electromechanically. Preferred cylinder locks employ pin tumblers and disc tumblers. In some embodiments, the tumblers are arranged in a row in the cylinder plug for actuation by the appropriate key. In other embodiments, the tumblers are positioned circumferentially around the cylinder, and are actuated by a tubular key. The locks can be double locks, preferred examples of which employ a dual locking cylinder. Locks such as these allow for the simultaneous engagement of a shackle and an anchor, whereby a first retainer (e.g., a steel ball or bolt) engages the shackle and a second retainer (e.g., a bolt or cam) engages the anchor. The second retainer can engage the anchor in any manner that prevents the locking device (e.g., a padlock), once engaged with the anchor, from being removed from the anchor until the lock is unlocked. Thus, when in the locked position, the second retainer is positioned proximate to the anchor. Such positioning includes embodiments wherein the retainer that engages the anchor (or flange) outside of its excluded volume, as well as embodiments wherein the retainer engages the anchor by positioning within the excluded volume of the anchor once the locking device is positioned about the anchor in a manner suitable for engagement. For example, in some embodiments the second retainer is adapted for insertion into a structure in the anchor, e.g., a recess adapted or otherwise suited to receive the second retainer in a manner that prevents the locking device from being removed from the anchor when the lock controlling the second retainer is locked, thereby deploying the second retainer.

The lock(s) used in a locking device (e.g., a padlock) of the invention are opened (i.e., unlocked or actuated) using the particular knowledge, equipment, or signal necessary for the particular lock. Thus, a combination lock can be opened using the appropriate combination, i.e., the particular series of alphanumeric symbols or other icons required to open the particular lock. A key-actuated lock, on the other hand, is a lock that can be opened or unlocked using a mechanical key that has been keyed to have the particular mechanical structure required to move the lock. In embodiments using cylinder locks, for example, insertion of the correct key allows the tumblers in the plug to properly align such that the plug can be rotated in relation to the shell by turning the key. As the plug is connected (directly or indirectly through one or more mechanical linkages) to other parts of the lock, the rotation of the plug is translated to, for example, a cam, bearing, or bolt that disengages from the shackle, thereby allowing it to move. Other locks may also be used, including power locks actuated by a credential such as a magnetic or electronic card that is read by a card reader or by a signal transmitted to a receiver associated with the lock. When a card reader reads a card encoded with the appropriate information, the one or more locks connected thereto are opened. Similarly, power locks can be actuated remotely using a transmitter to transmit a signal to a receiver that directs the actuation of the lock upon receipt of the appropriate signal. As will be appreciated, in some embodiments employing one lock to engage the shackle and another lock to engage the anchor, the same information, tool, signal, or other credential can be used to open both locks. In other embodiments, a different tool, signal, or other credential or information actuates each lock.

The lock bodies of the locking devices of the invention can be made from any suitable material, which may vary depending on application. Preferred materials include metals, plastics, and other materials that are inexpensive and can be readily shaped into desired forms by such techniques as stamping, casting, or molding. If desired, decorative and/or protective coatings or layers can be applied to the outer surfaces of the locking devices of the invention.

Beyond locking devices themselves, another aspect of the invention concerns lock systems. Such systems employ one or more locking devices of the invention and at least one complementary anchor attached to (or capable of attachment to) a structure for each locking device, such that when a locking device and anchor are engaged, they can be locked together, thereby securing the locking device (and any article locked thereto via a shackle) to the structure. A locking device may then be detached from its complementary anchor by unlocking the lock that secures it to the anchor. The lock that engages a shackle attached to the locking device may also then be unlocked. Whether a shackle is unlocked when the device is released from its anchor will depend, for example, on the type of lock used. As will be appreciated, in certain preferred embodiments a lock engaging a shackle may be unlocked without unlocking the locking device from the anchor. Alternatively, it may desirable to disengage a locking device from its anchor without releasing the shackle.

The anchors used in conjunction with the locking devices of the invention are of any design or configuration that is compatible with, or complementary to, the port in the particular lock body adapted to detachably receive the corresponding anchor. In certain preferred embodiments, the anchor comprises a flange that can be attached or fastened to a structure. Preferable attachment techniques include bolting, screwing, pinning, welding, or bonding the flange to the structure. Flanges enable locking devices with complementary lock bodies to be mechanically locked or mated thereto such that the locking devices can only be separated from the flanges by, for example, sliding or twisting a complementary locking device to disengage it from a complementary flange. As described elsewhere in this specification, to prevent detachment of a locking device from a structurally complementary anchor, the locking device includes a lock function that, when actuated (e.g., by deploying an element such as a cam or pin to engage the anchor), prevents translation of the locking device in relation to the anchor.

For certain applications, such as anchoring a locking device to a building, panel, or vehicle, preferred anchors comprise flanges attached to the structure using one or more screws, bolts, or retaining clips or pins. While such anchors are susceptible to removal from the structure in the absence of a locking device according to the invention that conceals the component(s) used to effect attachment, detachable engagement by such a locking device can prevent or limit the opportunity for such removal due to the anchor's partial, substantial, or complete concealment by the locking device, thereby affording secure attachment to a structure not only of the anchor, but also of a locking device engaged therewith as well as any object locked to the locking device via a shackle.

It is understood that the summary of the invention described above is non-limiting and that other features and advantages of the invention will be apparent from the following brief description of the drawings, the drawings themselves, the detailed description of the invention, and the appended claims.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 1A-F shows six cutaway side views of certain preferred lock body/anchor configurations for engagement of the flange portions of an anchor (i.e., the lock body-engaging elements) with the complementary portions of the lock body (i.e., the anchor-engaging elements) of a locking device according to the invention.

FIGS. 12A1-2, 12B1-2, 13A1-2, and 13B1-2 depict representative embodiments where the anchor, or the structure to which a locking device is to be detachably engaged, includes an element (or combination of elements) that can be inserted into or through the anchor for the purpose of engaging the anchor/structure. In the embodiment depicted in FIG. 12, the locking device engages the anchor by rotation after insertion into the anchor. To prevent unwanted disengagement, the anchor is also configured to receive a cam that can be deployed from the locking device to prevent rotation.

Figure 1:
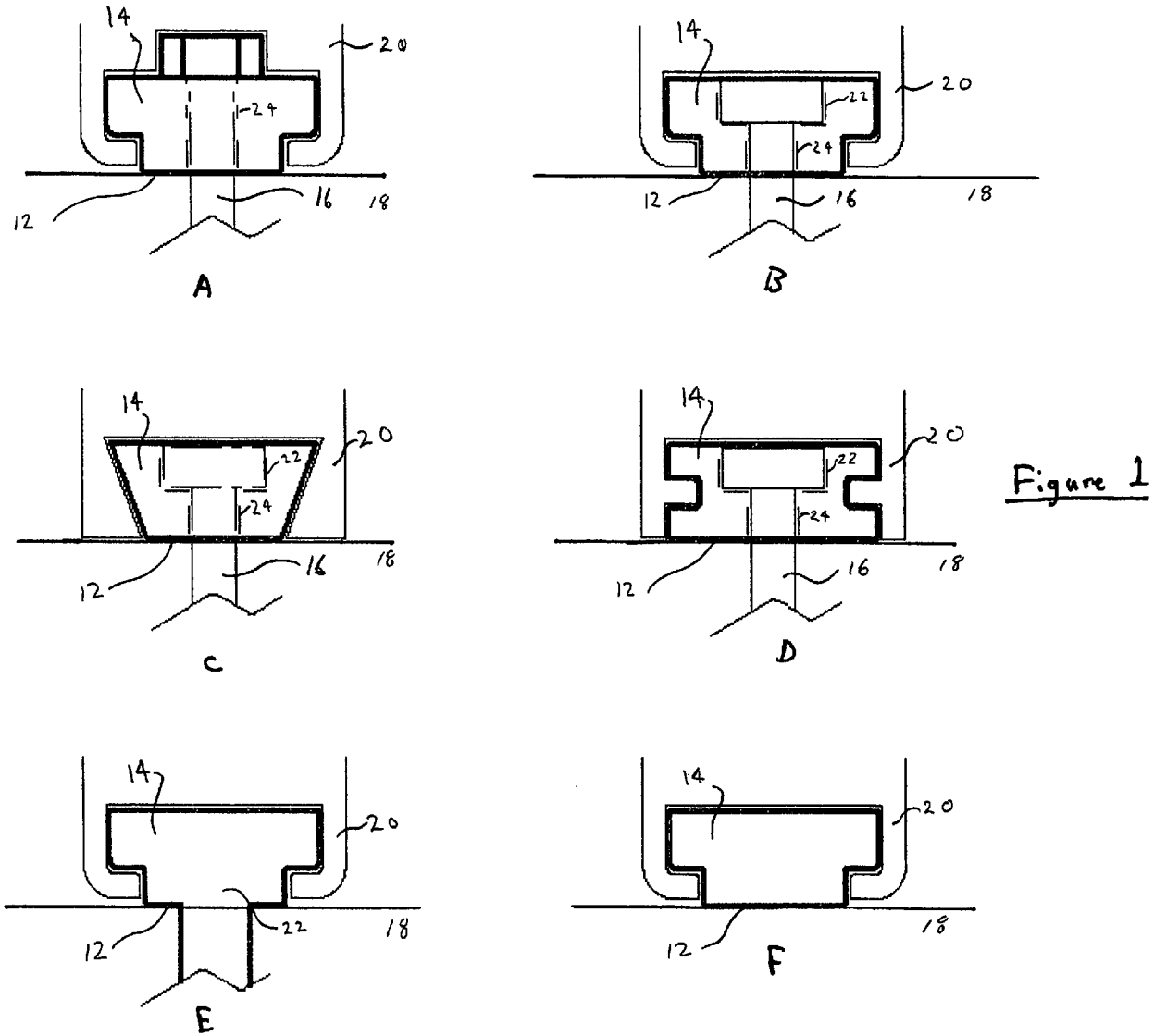

As those in the art will appreciate, the embodiments represented in the attached drawings are representative only and do not depict the actual scope of the invention. For example, the flange portion of an anchor of a lock system according to the invention may have any profile or shape suitable for mechanically engaging the lock body so as to prevent the padlock, when engaged with the anchor, from being disengaged from the anchor. These and other representative embodiments are described below in greater detail.

DETAILED DESCRIPTION

The present invention concerns secure, yet detachable, anchorable lock systems, the components of such systems, and methods of using such systems to secure objects. Briefly, a lock system of the invention comprises a locking device adapted to detachably engage an anchor, which anchor provides for fixed attachment of the locking device (e.g., padlock) to a structure.

A. Locking Devices

One component of the lock systems of the invention is a locking device that employs one or more locks to provide two functionalities: shackle engagement and release, so that a desired object can be secured by the lock(s); and anchor engagement and release, so that the locking device embodying the locks (e.g., a padlock), and any object(s) locked to it via the shackle, can be securely attached to a structure. A variety of preferred locking devices and anchors are described below in representative, non-limiting terms.

1. Locks

In this invention, the anchor- and shackle-engaging functionalities of a particular locking device (preferably, a padlock) are provided by one or more locks housed in a lock body. Preferred locks include cam locks and cylinder locks, although any lock, or combination of locks that provide the recited functionalities can be adapted and configured for use in the context of the invention without undue experimentation in view of this specification. For purposes of illustration, in some embodiments employing locks such locks cam locks and cylinder locks incorporated in a padlock, the padlock comprises two separate locks, for example, a cam lock for detachably engaging the anchor and a cylinder lock for detachably engaging the shackle. In such embodiments, each lock may be a combination lock, a key-actuated lock, or a lock actuated by a credential (e.g., a smart card) or signal. For efficiency, when two locks are employed (e.g., one for shackle engagement and one for anchor engagement) in a locking device, the same key, combination, credential, or signal preferably actuates each lock, although in some embodiments, each lock is actuated by a different combination, key, credential, or signal. Indeed, for lock systems that involve multiple locking devices and anchors, it is often preferred to use a lock for anchor engagement that uses the same key, combination, or credential for each lock. In this way, each anchor can be secured to or detached from a structure using the same information (i.e., combination), tool (e.g., key or card), or signal, whereas a different, preferably, unique key, combination, or credential is used to unlock the shackle that can be engaged by the particular padlock. Here, "unique" applies to the particular set of locks employed in the particular system. Thus, if the system has 250 different anchors and 250 locking devices, each of which engages one shackle, it is preferred that each lock for shackle engagement use a key that only unlocks that particular lock. Of course, one ore more master keys (or other tools, information, credentials, or signals used in the given system) may also be available to unlock some or all of the locks in the system, but these preferably are retained by proprietors or other supervisors and are not made generally available to, for example, workers or the public.

Some preferred embodiments of the invention employ locking devices that each comprise single cylinder lock, preferably of the double lock, type such that the shackle- and anchoring-engaging functions are embodied in the same lock. For example, the lock system depicted in FIGS. 2-6 employs a double lock based on a tubular key cylinder lock operated by one tubular key. In a double lock, the unlocking of each lock may be triggered by the same input, e.g., by rotation of the correct key in a cylinder, or, alternatively, by separate inputs, e.g., rotation of the correct key in one direction (e.g., counterclockwise) unlocks one of the locks, while rotation in the other direction (e.g., clockwise) unlocks the other lock, or by continuation of the same input (e.g., clockwise rotation of the cylinder 60 degrees unlocks one lock, while continued rotation another 60 degrees unlocks the other lock). Locks that can be operated in both clockwise and counterclockwise directions by a single key are termed bi-directional cylinder locks. Unidirectional cylinder locks, on the other hand, have a cylinder whose key can turn in only one direction from the key pull position. In embodiments where the locking device has two or more bolts, a single action may cause each bolt to move or, alternatively, each bolt may require a separate action (e.g., further rotation of the same key). Alternative embodiments employ a gang lock, in which the components that detachably engage different elements (e.g., shackles or anchors) can be moved simultaneously by a single action.

In other embodiments, multi-cylinder locks are used. Most frequently such locks employ a separate cylinder lock for each of the locking functionalities provided by the locking devices of the invention. Such locks can be configured in any suitable way. For example, the cylinders may be stacked or otherwise arrayed side-by-side such that the keyhole for each lock is on the same side of the lock device. In other embodiments, the cylinders are aligned on a central axis in a back-to-back manner such that the keyholes are on opposite ends of the lock device. Many other multi-cylinder configurations can also be employed to achieve the lock functionalities of the invention.

Preferred locks for use in the invention include pin and tumbler locks, as well as wafer tumbler locks. To provide adequate security, a lock preferably uses a key, combination, credential, or signal that is sufficiently unique in the particular lock system such that it is unlikely that one key could operate two or more locks in the system, except in some embodiments where a single locking device comprises two or more locks. Regardless of the number of locking devices and anchors in a particular lock system, each lock preferably comprises a sufficient number and arrangement of tumblers to prevent easy picking or other unauthorized opening of the lock.

The locks of the invention include those that are operated manually, for example, by rotation of the correct key placed in the keyway of a cylinder lock, while in other embodiments, power locks are employed. When a power lock is used, the locking device can be energized by any suitable power source, e.g., a battery or battery pack, by line or low voltage power supplies, including power supplied by photovoltaic systems. Preferred power locks are those wherein a solenoid or servo moves a bolt to lock or unlock the particular lock upon actuation, directly or through one or more mechanical linkages. When a power lock is employed, the lock (and locking device) may also include the components necessary for manual operation of the lock, which may be necessary in the event of a power failure, for example.

2. Lock Bodies

The lock(s) used in a particular locking device of the invention are housed in a lock body. A lock body not only protects and shields the lock(s) of a locking device, it also is manufactured to have one or more elements capable of engaging a complementary anchor such that the locking device/anchor combination, when attached to a structure through the anchor, is secured to the structure. These elements are referred to as anchor-engaging elements, and a locking device according to the invention includes at least one such element. The anchor engaging elements are typically included in a port in the lock body that provides for engagement of the anchor, either before or after the anchor is secured to a structure.

Given the nature of the invention, lock bodies are preferably made from materials that resist impact, thermal challenges (i.e., extreme heat or cold), and the like. Preferably, such materials are easily formed into the desired shape, such as by stamping, casting, or molding. Preferred materials include metals and plastics, especially thermoplastics, including those that include reinforcing fibers in a resin. Lock bodies can be made from one or several pieces, each of which may be made of the same or different material. A variety of these materials are known in the art, and any suitable material, or combination of materials, can be employed.

The particular design of a given lock body useful in the present invention depends on many factors, including the size, number, and type of lock(s) used; how the locks are actuated (e.g., by a key, combination, magnetic or electronic credential, or by a signal); whether the lock(s) are power locks or are actuated manually; the number and type of shackles to be engaged by the shackle-engaging lock; the number, size, shape, and locations of ports needed for the shackle(s) and lock(s) used; how the locking device is to engage its anchor; the intended use of the locking device/anchor combination, etc. Given these and other considerations that will be apparent to those skilled in the art upon review of this specification, the particular design, method of manufacture, and materials used to make a lock body is left to the discretion of the ordinarily skilled artisan.

B. Anchors

In order to secure a locking device to a structure, in many embodiments the lock systems of the invention use an anchor configured to engage those elements on the lock body intended to engage the anchor, i.e., the anchor-engaging elements. In other embodiments, the structure itself is adapted (e.g., by drilling or during construction or manufacture) to detachably engage a locking device according to the invention. Anchors can be designed (or structures adapted or constructed) to engage locking devices in any way, provided that the engagement is releasable. Preferred methods of engagement involve mechanical locks, where one or more anchor-engaging elements of a lock body become positioned proximate to a corresponding element (i.e., a lock body-engaging element) of the anchor (or structure) such that the anchor (or structure) and lock body cannot be separated until desired. A mechanical lock is typically formed between two components that are complementary over at least a part of their respective structures. For example, one component having a pin, ball, bolt, shaft, or the like can be mechanically locked to another by having its pin, ball, bolt, or shaft inserted into a bore shaped to receive it. When the pin of one component, for example, is inserted into a complementary bore in the other component, the two components can become locked together. In other embodiments, one component (e.g., the anchor) may comprise a flange having a shape that complements a structure on the other component (e.g., such as a ball and hitch arrangement), such as an anchor-engaging port, which is configured to have one or flanges complementary to one or more of those of the anchor.

In many embodiments, an anchor (or structure) comprises more than one flange or other component for engaging a complementary locking device. As used herein, a flange of an anchor (or structure) can comprise more than one element for engaging a complementary lock body. These lock body-engaging elements may be spaced around the flange portion such they are not continuous or contiguous, or they may comprise a continuous structure.

Anchors (or a portion of a structure adapted to serve as an anchor) useful in the context of the invention can comprise one or more pieces. For example, in some embodiments the anchor comprises a flange portion and a bolt, screw, pin, or similar member for securing the flange portion to a structure. In some embodiments, the flange portion itself may comprise two or more pieces. For example, two washers, each having a different outer diameter and hole in the center for insertion of a bolt or screw, can be stacked such that their holes are concentric, with the larger washer on top. The portion of the larger washer that extends beyond the lower washer in such a structure represents the lock body-engaging element, and in such a configuration extends completely around the structure such that a complementary lock body can slidingly engage the flange radially from any angle. In profile, such a configuration has a step profile. Another useful flange configuration includes three stacked three washers. The upper- and lowermost washers are preferably of the same outer diameter, while the middle washer has a smaller outer diameter. When viewed in profile, such a configuration presents a "key" or slot that can serve as a lock body-engaging element for a locking device that includes complementary anchor-engaging elements in the port for engaging the anchor. As will be appreciated, structures that are functionally equivalent to stacks of two or more washers can readily be manufactured as single pieces. Moreover, based on this specification, a multitude of other flange portions useful in the context of the invention will be apparent to those in the art, and all such flange portions are within the scope of the invention.

In still other embodiments, the lock body-engaging elements of a flange are not located on a surface of the anchor that bounds a portion of the excluded volume of the anchor (or structure). Such flange elements are external flange elements. Instead, the flange portion is within the anchor (or structure), such that at least some, and preferably all, of its lock body-engaging elements do not have surfaces that define the anchor's excluded volume. In such embodiments, the locking device need not include a port for engaging a complementary anchor or flange portion thereof; instead, it may include a component such as a post that includes anchor-engaging (or structure-engaging) elements. For example, in some embodiments wherein the locking device comprises a post, the locking device can detachably engage the anchor by rotating it after the post has been inserted into the anchor in order to engage the anchor-engaging element(s) of the post with the lock body-engaging elements of the anchor. In such embodiments, to prevent rotation of the locking device so that it can be disengaged from the anchor, one or more structures (e.g., cams) can be deployed from the locking device to engage complementary structures (e.g., slots or other ports) in the anchor after the locking device has been rotated to engage the lock body-engaging elements of the anchor. In other embodiments, rotation of the locking device is not required. In such embodiments, a lock in the locking device actuates a structure to detachably engage the anchor (or structure). Such detachable engagement can be accomplished in any suitable way, for example, by driving a pin into a bore in the anchor, by creating sufficient friction between the anchor and the anchor-engaging structure of the locking device, etc. Of course, anchors (or structures) that include both internal and external flange elements can also be made and used in the practice of this invention.

Other anchor embodiments do not include a flange. Instead, the anchor includes a structure such as a bore that can be engaged by a pin inserted therein. Alternatively, the anchor may comprise a cavity (e.g., a bore) that the surfaces of which can be engaged by another component in a such a way as to create sufficient friction between the anchor and other component so as prevent withdrawal of the other component. If desired, the cavity may also include a flange. As will be appreciated, the invention also envisions embodiments that do not employ a separate anchor per se. Instead, the structure is prepared, for example, by drilling a hole, to detachably receive a locking device according to the invention that deploys, for example, a friction-generating element to engage at least a portion of the prepared surface of the structure.

Anchors comprising a flange portion include those wherein another component is used to fix the flange to a structure. Such components include fasteners such as bolts, screws, nails, pins, and similar components. Preferred fasteners include self-tapping machine screws, metal screws, wood screws, lag bolts, and bolts threaded to mate to a metal structure drilled and tapped to match the bolt's thread pattern. Fasteners can also comprise augers to allow anchors to be attached to the ground (including sand and soil).

Typically, a fastener comprises a head and a shank, although any fastener that can attach and anchor to a structure can be used. The head of the fastener engages the flange and the shank (which is usually cylindrical) protrudes through a slot, bore, or other structure in the flange portion so as to allow fastener to engage a structure for retention of the locking device/anchor combination. At least a portion of the shanks of bolts and screws is threaded. On bolts, the threads are designed to mate to nut or portion of a structure having a complementary thread pattern. The heads of bolts and screws typically have a shape allowing them to be driven (i.e., by rotation) by a suitable tool. In some embodiments, the head of a bolt or screw is solid; in other embodiments, the head contains a cavity. Such cavities may be configured for driving (e.g., by a wrench such as an Allen wrench or TORX® wrench). They may also serve as cavities into which a pin, cam, or similar retaining element can also be positioned to prevent a locking device from being translated in relation to an anchor to which it has been secured. In embodiments that employ pins, the shank of the pin typically comprises an element near the end opposite the head that allows the pin to be retained after it has been inserted through the flange portion and the structure for securing the lock system (e.g., a portable panel). Such elements include bores that accept cotter pins, for example, as well as channels for circlips, etc. To prevent unwanted removal of the anchor and a locking device secured thereto (e.g., by a thief), it is preferred that the locking device substantially or completely conceal at least the fastener, and preferably the entire anchor, when detachably engaged with the anchor.

Alternative anchor embodiments do not employ bolts, screws, etc. to secure the anchor to a structure. Instead, the anchor (e.g., the flange) is welded, bonded, or otherwise permanently attached to the structure. In this context, "permanent" means that the anchor cannot be readily removed once attached to a structure. For example, when an anchor is welded or bonded to a structure, it cannot be readily removed. Other types of attachment, however, are reversible, in that an anchor can be removed by reversing the process used to attach it to a structure. For example, if an anchor is bolted or screwed to a structure, it can be removed by unbolting or unscrewing the bolt or screw, as the case may be.

C. Preferred Lock Systems and Components

FIGS. 1-13 depict various embodiments of the invention. Detailed descriptions of these particular embodiments appear in the following paragraphs. As those in the art will appreciate, however, the full scope of the invention described in this specification, including the appended claims, greatly exceeds the several particularly preferred embodiments described below. Thus, these embodiments are merely representative, and it is understood that the scope of the invention is defined by the claims appended to this or any related patent application claiming priority hereto.

FIG. 1 depicts six embodiments, A-F, of a lock system of the invention. In panels A-D, the anchor (12) comprises a flange (14) and a bolt member (16) attached to a surface of a structure (18). Panels A-D each show a flange (14) having a different profile for engaging the lock body (20) and a bore (24) through which the bolt member (16) is inserted for securing the flange (14) to the structure (18). In panel A, the profile is a step-profile at the side of the flange, and another step profile on the upper portion of the anchor (due to a non-recessed bolt member (16) for anchoring the flange (14) to the structure (18)). Panels B, E, and F also depict a flange (14) having a step profile for engaging the lock body (20). In panels B-D, the flange (14) is secured to the structure (18) by way of bolt member (16) that fits into a recess (22) in the flange (14). Panel C shows an anchor (12) wherein the flange (14) has a tapered profile for engaging the lock body (20). Panel D shows an anchor (12) wherein the flange (14) has a keyed profile for engaging the lock body (20). Panel E shows an embodiment where the anchor (12) is a single piece, with the flange and bolt member constituting an integrated, single unit (22). Panel F illustrates an embodiment where the anchor (12) is attached to the surface of structure (18) without using a bolt member, for example, by welding or through the use of an adhesive.

Figure 2:
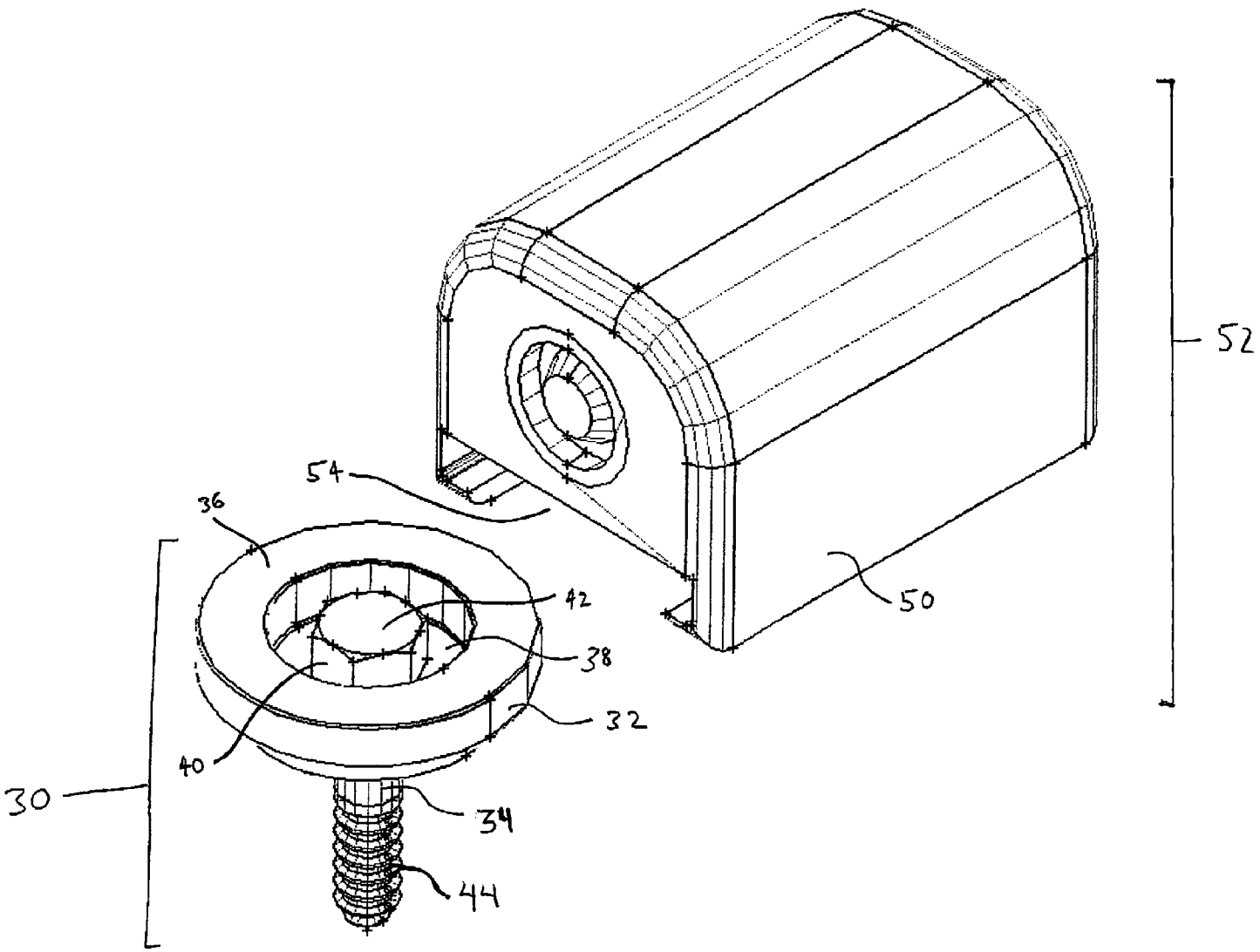
FIGS. 2, 3, 4, 5, and 6A-C show the similar embodiments of a lock system of the invention from slightly different views. In these embodiments, the anchor comprises two pieces, a flange and a screw for securely fixing the flange to a structure. The flange has a recess for countersinking the head of the screw. The locking device is shown with and, for simplicity and purposes of illustration only, without ports for shackle attachment. The shackle has two arms, and the lock body has two ports to accept the shackle arms. In these embodiments, the lock of the locking device is a key-actuated cylinder lock; thus, the lock body includes a port that exposes the end of the lock into which the key can be inserted.

FIGS. 2-6 show the similar embodiments of the invention from slightly different views. Specifically, FIG. 2 depicts a view of an embodiment where the anchor (30) comprises a flange (32) and a bolt member (34) for engaging a padlock (52). The flange (32) has an upper surface (36) and a recess (38) enabling the bolt member (34) to be countersunk such that the bolt head (40) is recessed such the top (42) of the bolt head (40) protrudes from the recess (38) no higher than the upper surface (36) of the flange (32). Not shown is the bore in the flange (32) that allows the threaded shank (44) of the bolt member (34) to protrude through the flange (32) to allow the flange to be secured a structure (not shown). Here, the flange (32) has a stepped side profile for engaging the anchor-engaging port (54) of the lock body (50) of the padlock (52). Not shown in this figure are ports in the lock body for insertion of a shackle, nor is the shackle shown.

Figure 3:
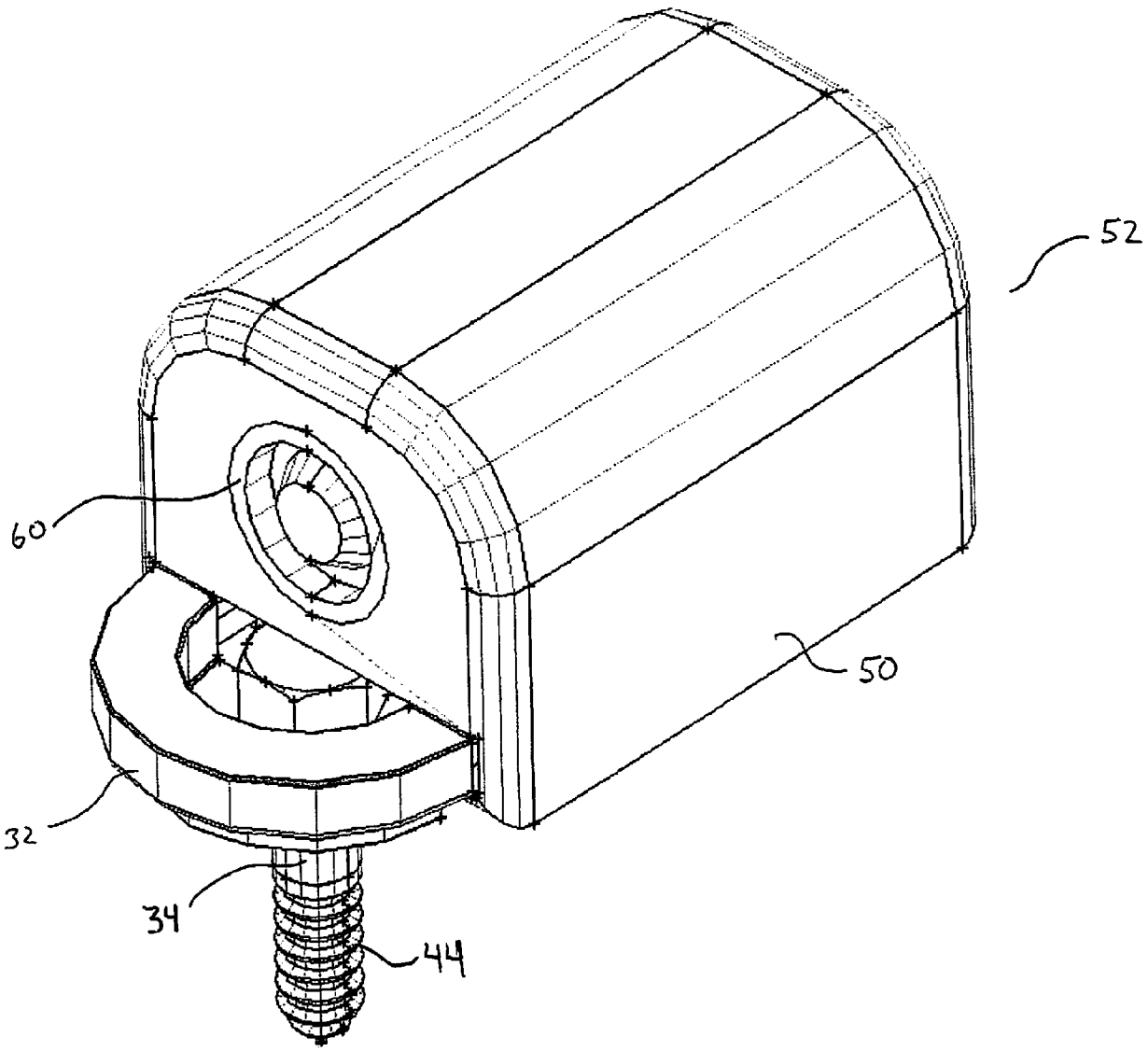

FIG. 3 illustrates the same embodiment of the invention as is depicted in FIG. 2, except that in this figure the padlock (52) has engaged the flange (32) of anchor the (30), although approximately one-half of the flange (32) remains visible. Also shown in this figure is the end of the lock (60) that is accessible through the lock body (50) for the purposes of locking and unlocking the padlock.

Figure 4:
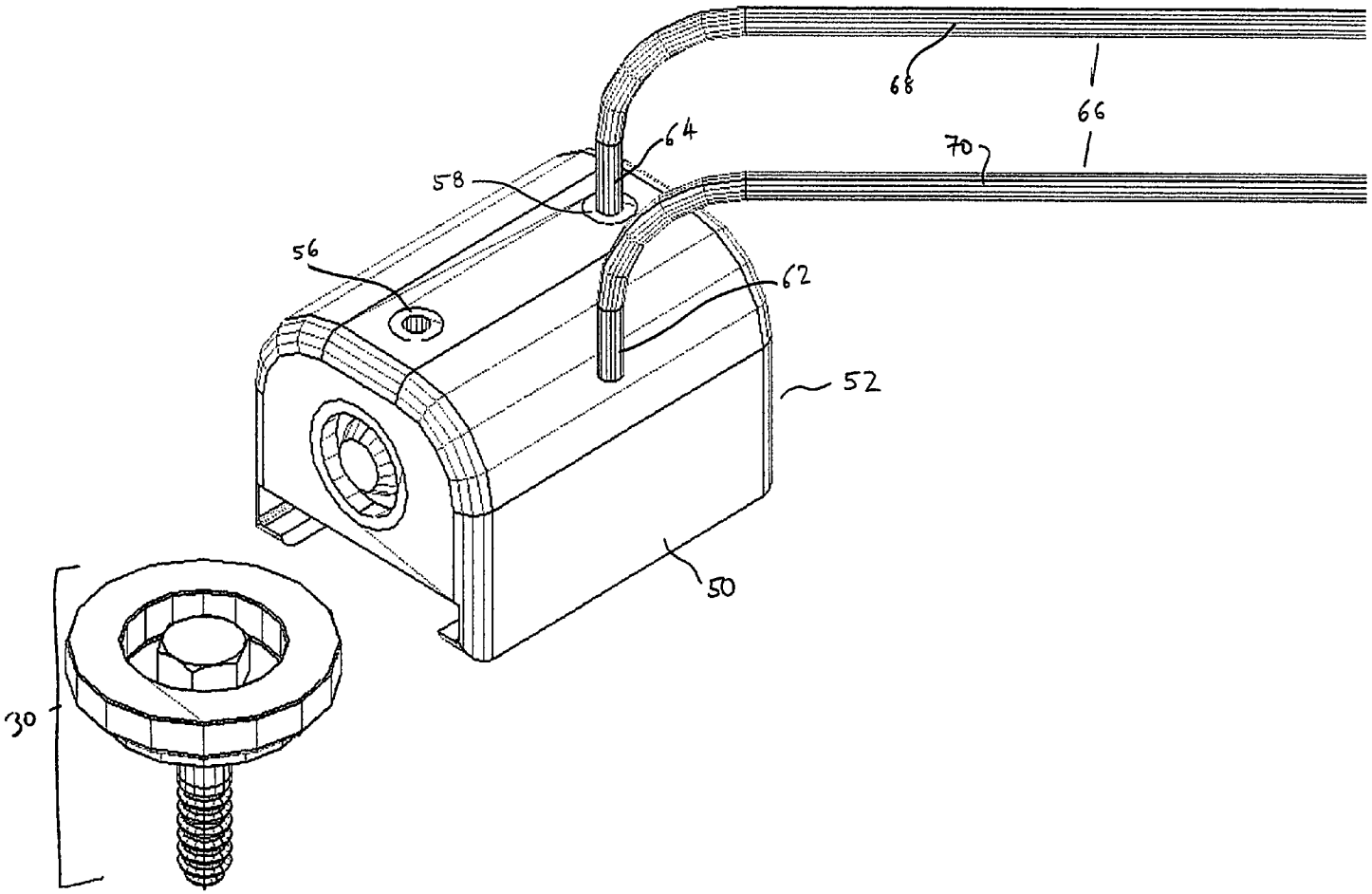

FIG. 4 illustrates additional details of the embodiment shown in FIG. 2, the difference being that FIG. 4 shows additional detail. In particular, this figure shows the lock body (50) having two ports (56 and 58) for the ends (62 and 64) of the shackle (66). In this embodiment, one arm (68) of shackle (66) remains in the padlock (52) when the lock is unlocked, while the other arm (70) is disengaged from the padlock (52). The figure also depicts the anchor (30) shown in FIG. 2.

Figure 5:
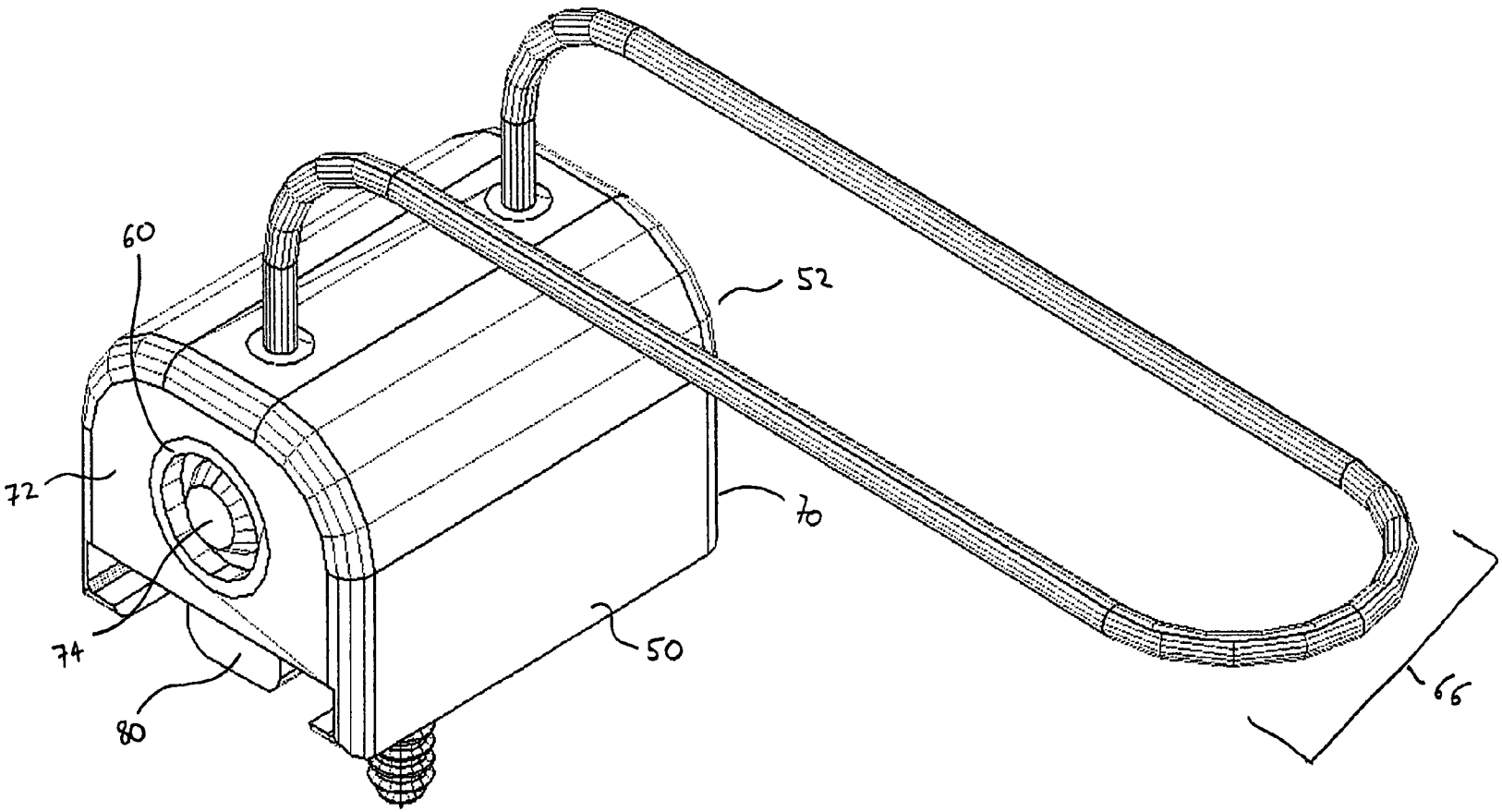

FIG. 5 illustrates the embodiment shown in FIGS. 2-4 after the padlock (52) has been translated over the anchor (not shown) to engage the flange (not shown) in a way that substantially conceals the anchor beneath the padlock (52). Here, the padlock (52) is shown engaging and retaining the shackle (66). In addition, the lock includes a moveable cam (80) that is shown in a position that prevents the padlock (52) from being moved from left to right (when viewed from the perspective of the drawing) in relation to the flange. To prevent movement of the padlock (52) from right to left over the flange, the lock may comprise an additional cam (not shown) or other retaining element to engage another part of the anchor (e.g., the head of the bolt member, the other side of the flange opposite that engaged by the cam (80), etc.). Alternatively, the lock body (50) may be configured such that the end (70) opposite the end (72) having an opening (74) for a key (not shown) to lock or unlock the lock (60) protrudes down a distance to prevent such movement once the padlock (52) fully engages the anchor (30).

Figure 6:
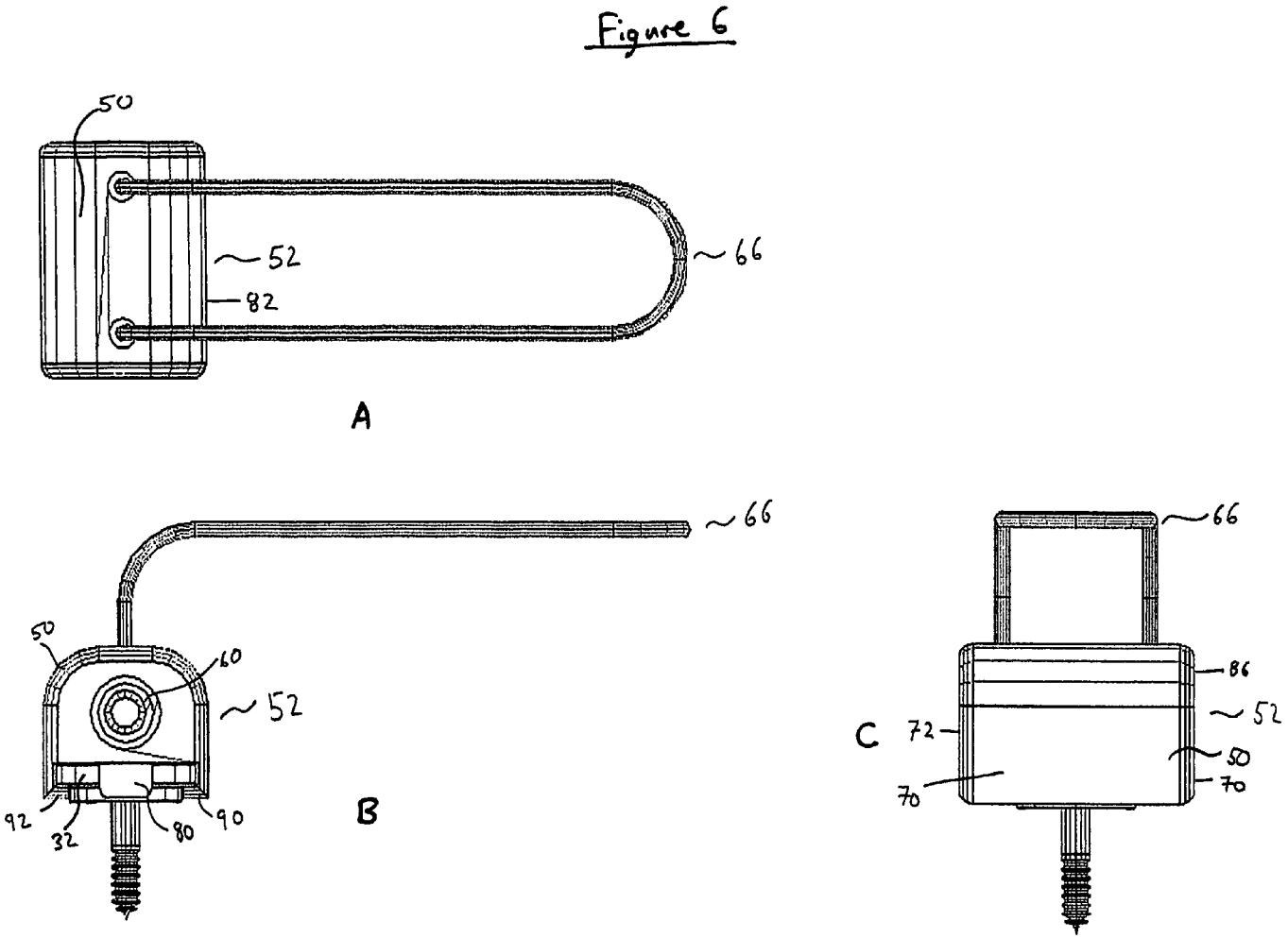

FIG. 6 illustrates three views (A, B, and C) of the lock system illustrated in FIGS. 2-5. In each these views, the shackle (66) is locked into the padlock (52). Panel A is a top-down view showing the padlock (52) engaged with and completely concealing the anchor. Panel B shows an end-on view that illustrates the cam (80) being deployed to as prevent lateral translation of the padlock (52) over the flange (32) of the anchor. Also visible in this view is the anchor-engaging port (54) that allows the lock body (50) to engage the flange (32) of the anchor. The flange (32) has a step profile for engaging the flange-engaging elements (90 and 92) of the lock body (50). Also visible from this view is the end of the lock (60) into which a tubular key (not shown) can be inserted to unlock the lock. Panel C shows an end-on view of the lock system according to the invention shown in panel B, but rotated 90 deg. to show a view from the front side (82) of the padlock (52). In panel C, the side (72) has the opening for the anchor-engaging port (not visible) and the opening for the key (not shown) for the lock (60), and the side (70) opposite to the side (72) extends down approximately the same distance as the sides (72 and 82) of the lock body (50) to prevent the padlock (52) from being translated along the flange (32) in the right-to-left direction toward the cam (68) (not shown, in panel C). As will be appreciated, in the embodiment shown in FIGS. 2-6, one lock (60) performs both the shackle-engaging and anchor-engaging functions.

Figure 7:
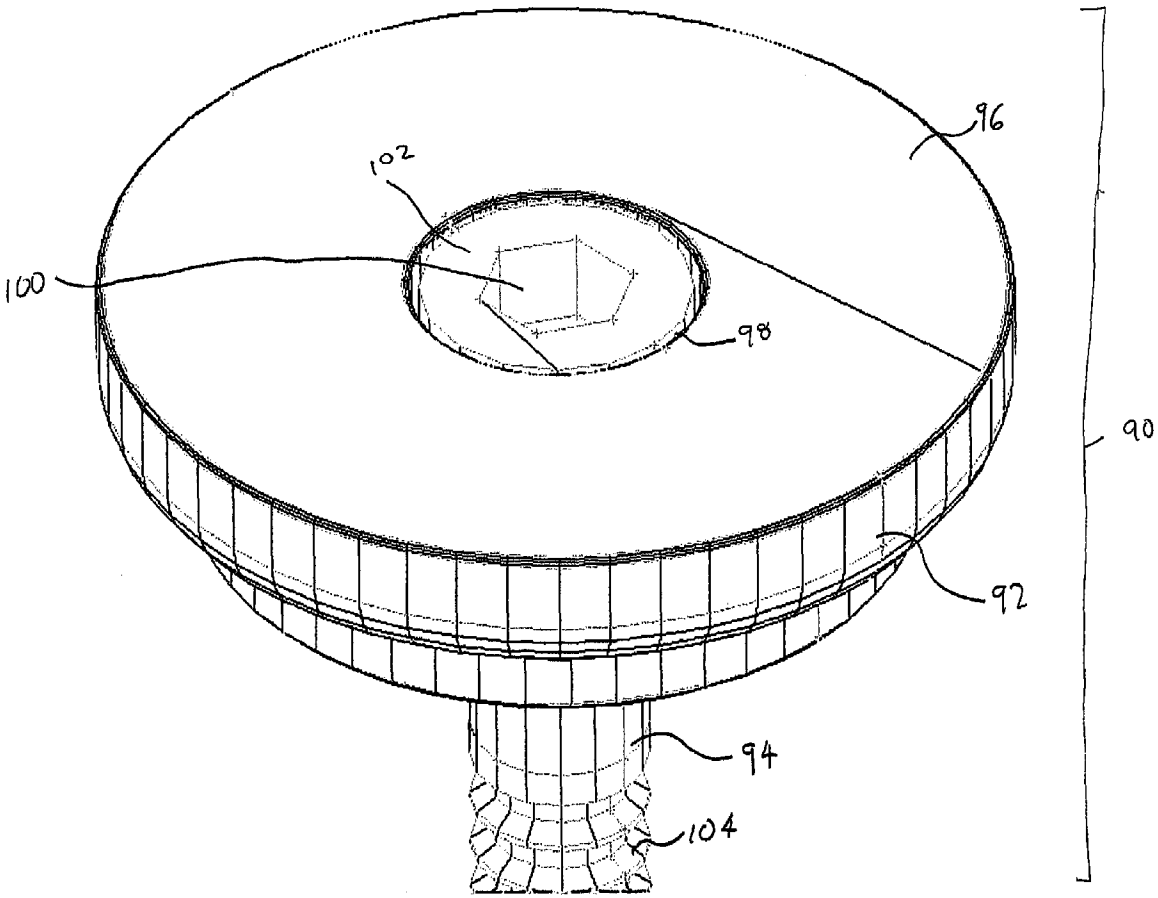
FIGS. 7, 8A-D, 9A-D, and 10A-D show several representative embodiments of anchors useful in the practice of the invention.

FIG. 7 illustrates an embodiment of an anchor (90) comprising a flange (92) and bolt member (94). The flange and bolt members may be separate pieces; alternatively, they can be manufactured as an integrated, single piece. As with the anchor depicted in FIG. 2, the flange (92) has an upper surface (96) and a recess (98) enabling the bolt member (94) to be countersunk such that the bolt head (100) is recessed such the top (102) of the bolt head (100) protrudes from the recess (98) no higher than the upper surface (96) of the flange (92). Not shown is the bore in the flange (92) that allows the threaded shank (104) of the bolt member (94) to protrude through the flange (92) to allow the flange to be secured a structure (not shown). Here, the flange (92) has a stepped side profile for engaging a complementary anchor-engaging port of a lock body of a padlock designed for use with the anchor shown.

Figure 8:
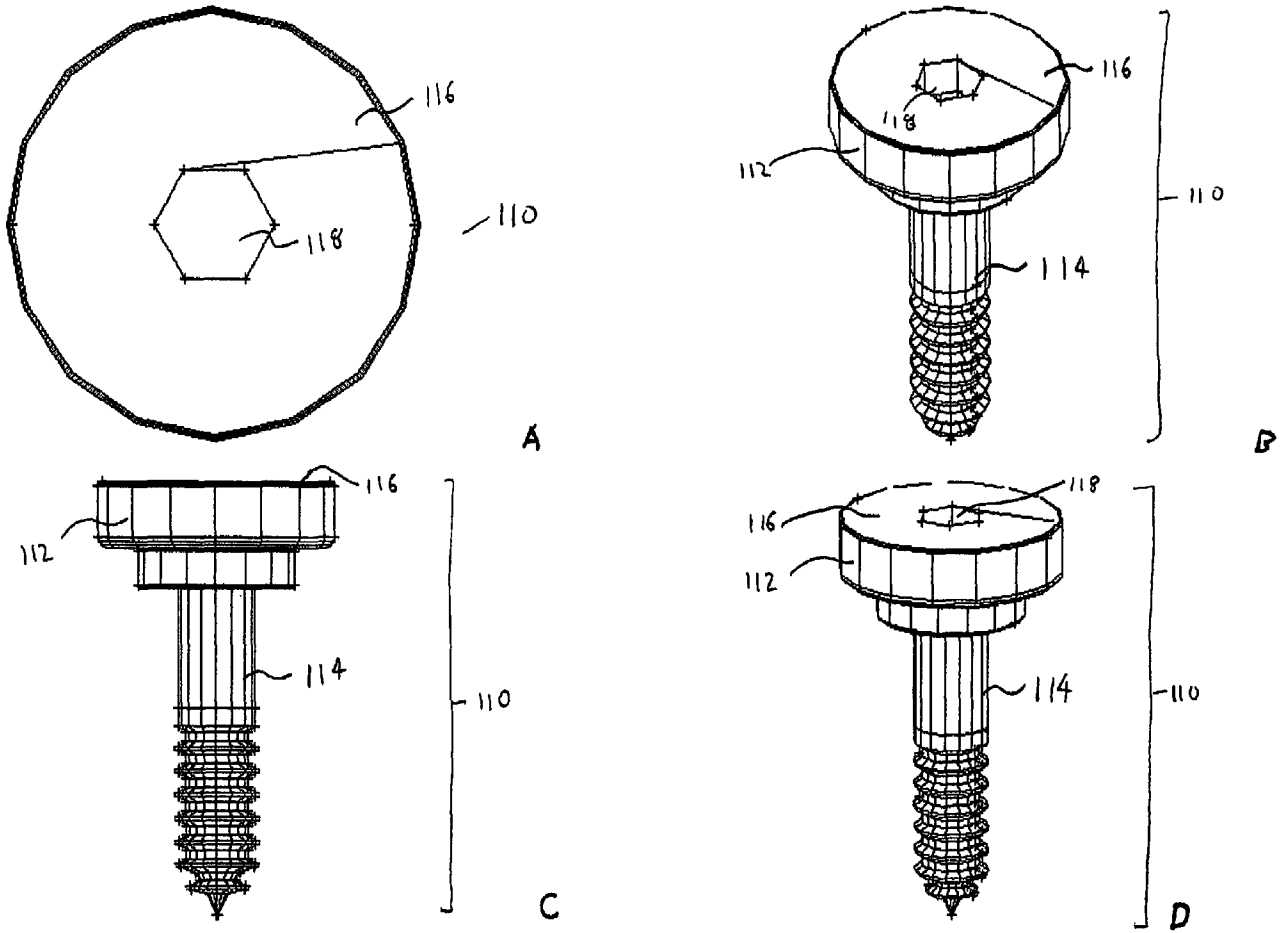

FIG. 8 depicts four panels (A-D) showing an embodiment of a one-piece anchor (110) comprising a flange portion (112) and screw member portion (114). As with the anchors depicted in FIGS. 2 and 7, the flange (112) has an upper surface (116) and a recess (118). In the embodiment depicted here, however, the recess is hexagonally shaped so as to be compatible with, for example, an Allen wrench for screwing the anchor into a structure (not shown). In this embodiment, the flange (112) has a stepped side profile for engaging a complementary anchor-engaging port of a lock body of a padlock designed for use with the anchor shown.

Figure 9:
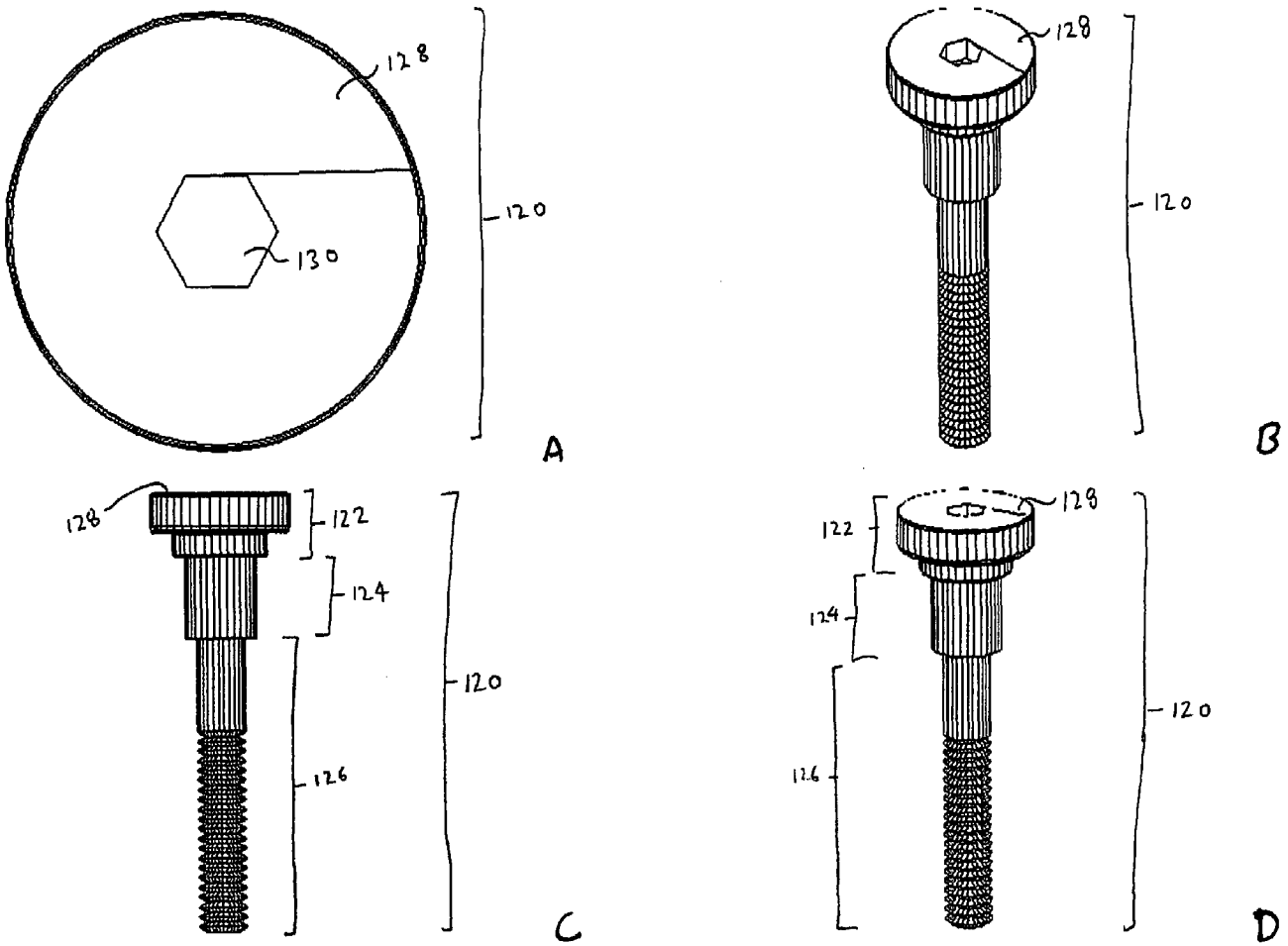

FIG. 9 shows four panels (A-D) illustrating an embodiment of a one-piece anchor (120) comprising a flange portion (122), a spacer portion (124), and bolt member portion (126). As with the anchors depicted in FIGS. 2, 7, and 8, the flange (122) has an upper surface (128) and a recess (130). As with the embodiment depicted in FIG. 8, the recess (130) is hexagonally shaped so as to be compatible with, for example, an Allen wrench for bolting the anchor to a structure (e.g., a motorcycle frame; not shown). In this embodiment, the flange (122) has a stepped side profile for engaging a complementary anchor-engaging port of a lock body of a padlock designed for use with the anchor shown.

Figure 10:
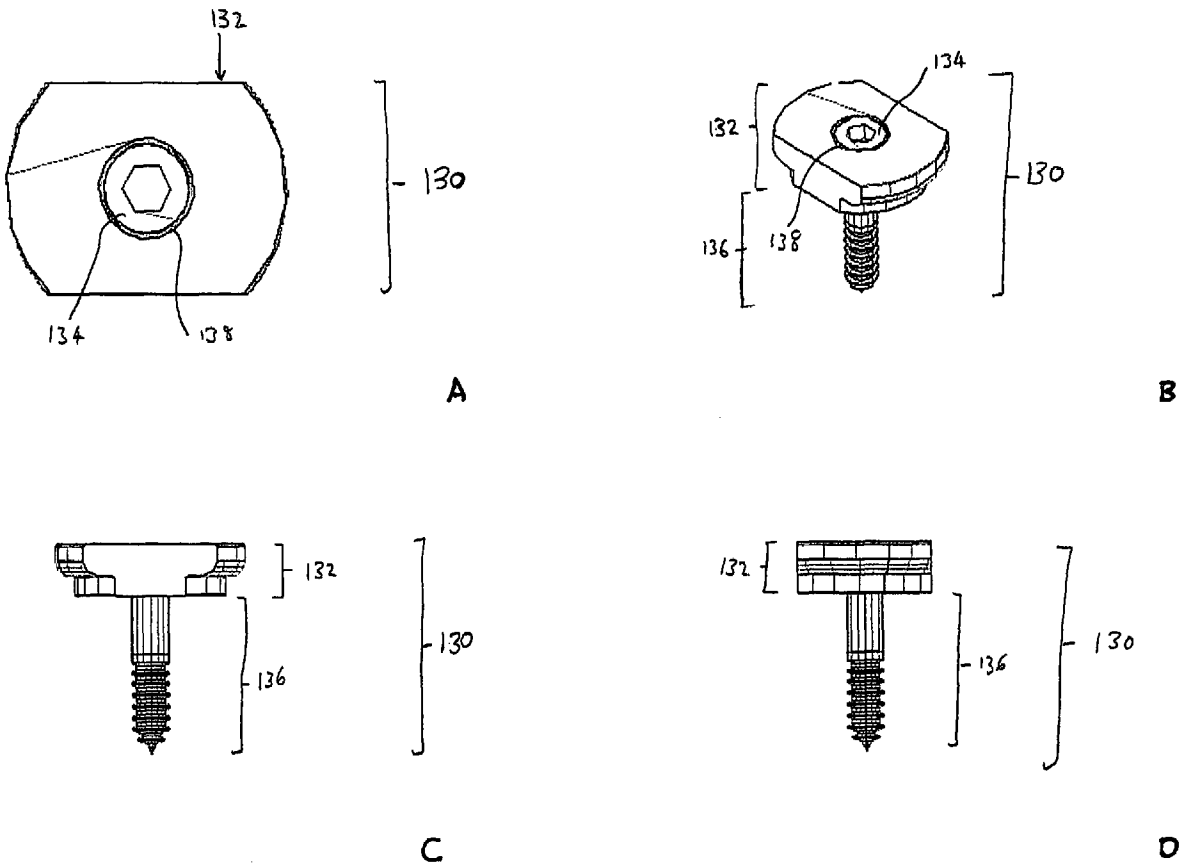
Figure 11:
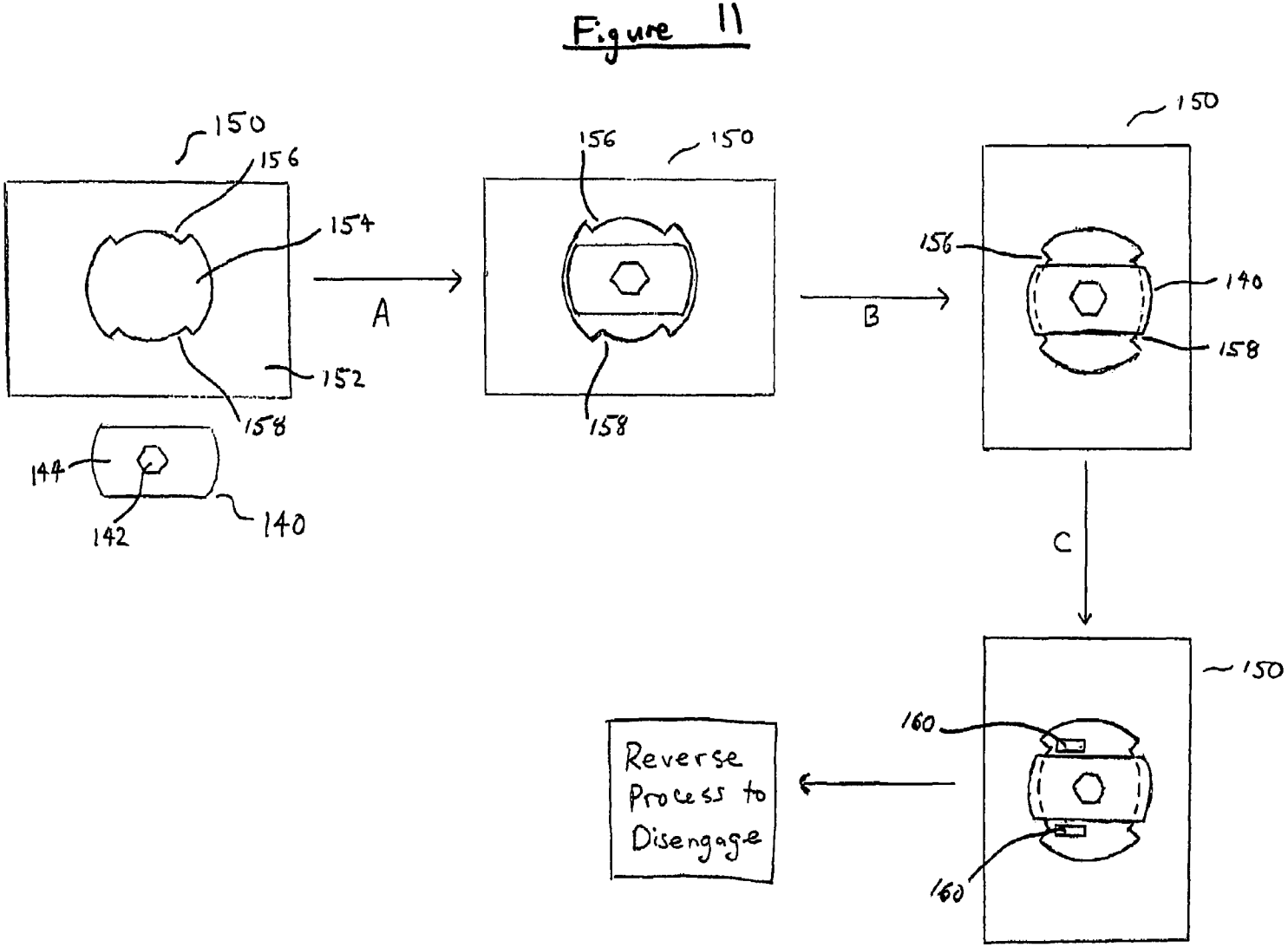
FIG. 11 depicts the process of engaging and disengaging one embodiment of a locking device of the invention with its corresponding anchor.

FIGS. 10 and 11 depict representative embodiments of the invention wherein a padlock is placed over an anchor and then rotated to secure the padlock to the anchor. FIG. 10 has four panels (A-D) each representing an embodiment of an anchor (130) similar to that illustrated in FIG. 7, and FIG. 11 illustrates the process of securing a padlock (150) to an anchor (140). In this embodiments illustrates, however, the flange (132) is not disk-shaped. Instead, when viewed from above, the flange (132) appears as a circle flattened on two sides. The flange (132) is secured to structure (not shown) using the screw member (134) that includes a head and shank. The bore through the flange (132) for the threaded portion (136) of the shank is not shown. In this embodiment, the head of the screw member (134) is countersunk into a recess (138) when joined with the flange (132). In this embodiment, when viewed from the side the flange (132) has a stepped profile for retention of anchor-engaging elements of a complementary padlock.

In FIG. 11, the anchor (140) is similar to that shown in FIG. 10, except that the anchor is a single unit wherein the flange and bolt/screw member (not shown) are integrated, with the anchor having a hexagonal cavity (142) disposed in its upper surface (144) for securing the anchor to a structure. Of course, alternate one- or multi-piece anchors can be substituted for the anchor depicted in the figure. As will be appreciated, the anchor (140) is suitable for engaging any padlock that has an anchor-engaging port (154) compatible with the shape and dimensions of the particular flange. Preferably, anchors as depicted in the figure are used to secure padlocks having a port on a surface, for example, the bottom surface (represented as bottom face (152) in FIG. 11), of the lock body that is large and deep enough to be placed over the flange such that when the padlock is placed on the anchor, the anchor (140) enters the cavity defined by the port (154). The padlock (150) can then be secured to the anchor using any suitable approach, for example, driving a bolt into a bore in the anchor that, when engaged, prevents the padlock from being disengaged from the anchor. In the particular embodiment shown in the figure, a padlock (150) having at least one anchor-engaging element (here, two such elements (156 and 158) are shown) incorporated into the padlock (150) can, once positioned (step A) over the anchor, be rotated (step B) such that the anchor-engaging element(s) (here, elements 156 and 158) engage the padlock-retaining elements of the anchor. Rotation of the padlock to disengage the anchor-engaging elements of the padlock and the padlock-retaining elements of the anchor (140) can be prevented by deployment (step C) by a lock of any suitable device, for example, one or more cams (160) that, when deployed, are positioned proximate to the edge(s) of the flange that do not have padlock-retaining elements, thereby preventing rotation and removal of the padlock from the anchor absent unlocking of the lock that provides for releasable engagement of the anchor.

Figure 12:
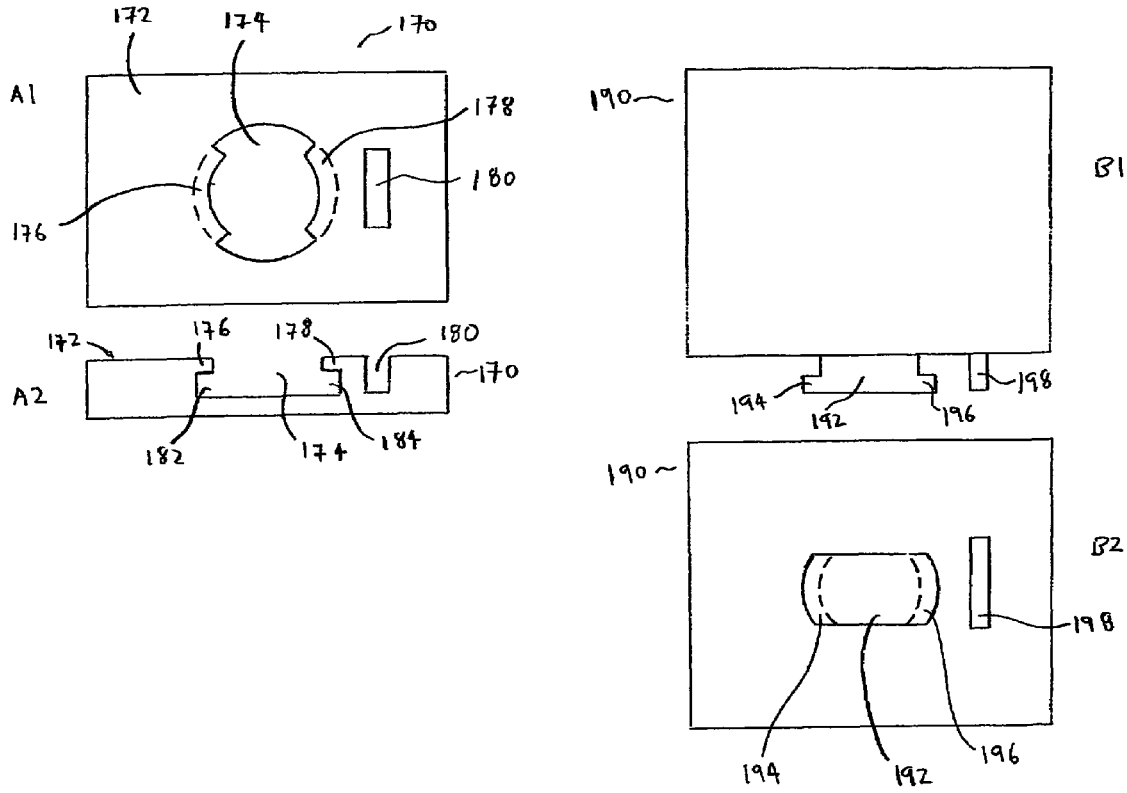

FIG. 12 illustrates a lock system embodiment comprising two elements, the anchor (170) (or portion of a structure adapted to serve as an anchor) and a locking device (180) according to the invention. Panel A1 depicts a top-down view of the anchor (170); panel A2 depicts a side view of the same anchor (170) in cross section. The anchor (170) has an upper surface (172) and a port (174) opened in the upper surface for insertion of a post element (192) of the locking device (190) shown in panels B1 and B2. The port (174) has two post-engaging flanges, or elements, (176 and 178), for engaging the anchor-engaging elements (194 and 196) of the post (192) of the locking device (190) when the locking device (190) is inserted into and rotated in the anchor (170) to engage the engaging elements (176, 178, 194, and 196). When the locking device (190) is rotated such that the elements are engaged, the anchoring-engaging elements (194 and 196) occupy voids (182 and 184) in the port (174). When so positioned in the anchor (170), the locking device (190) cannot be pulled from the anchor (170). To prevent the locking device (190) from being withdrawn from the anchor (170) after it has been rotated to bring the engaging elements (176, 178, 194, and 196) together in engaging, or locking, relation, a cam (198) or similar element can be deployed from the locking device (190) into the slot (180) that can be accessed through the surface (172) of the anchor (170).

Figure 13:
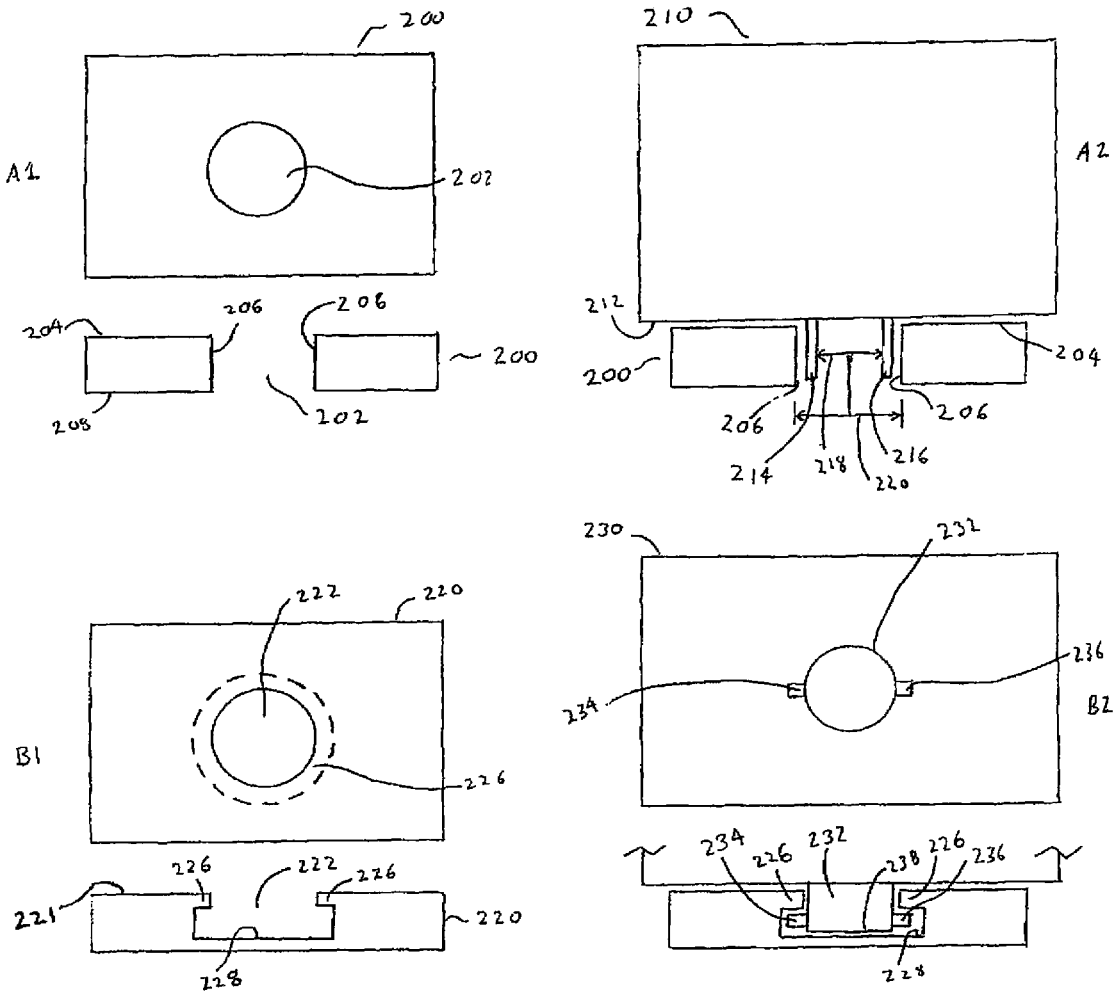
FIG. 13 shows two views (1 and 2) of two different embodiments (A and B) where the locking device comprises an element (or combination of elements) that can be inserted into or through the anchor for the purpose of engaging the anchor/structure.

FIG. 13 Shows two alternative embodiments of a lock system according to the invention. Panels A1 and A2 depict a lock system wherein a locking device (210) detachably engages an anchor (200) (or portion of a structure configured to serve as an anchor) via friction. Panel A1 shows two views of the anchor (200), a top-down view and a cutaway side view. The top down view shows a bore (202). Here, the bore is shown as being cylindrical, but this need not be the case in all such embodiments, as any suitable shape can be used. In the embodiment shown, the bore (202) extends through the anchor (200), from the upper surface (204) to the lower surface (208), although this is not essential in all embodiments of this type, as will be apparent to those skilled in the art. As shown in panel A2, the face (206) of the bore (202) is engaged by a friction-generating element deployed from the locking device (210). To lock the locking device to the anchor, the device (210) is positioned over the bore (202), with the bottom surface (212) of the device (210) being brought into proximity of the upper surface (204) of the anchor (200). The locking device detachably engages the anchor (or structure) by action of the lock functionality (not shown) responsible for engaging the anchor. Here, actuation of the lock (designated by arrow 218) forces the friction-generating portions (214 and 216) of the friction-generating element outward to engage the face (206) of the bore (202), as shown by arrow 220. If desired, the face (206) of the bore and/or the surfaces of the friction-generating portions (214 and 216) can be made to promote high levels of friction when engaged. As will be appreciated, in this embodiment, the locking device (210), once engaged the structure (itself or via an anchor attached thereto), can neither be removed from nor rotated in the anchor (200). In contrast, in the embodiment illustrated in panels B1 and B2, the locking device (230) can be rotated in the anchor (220) (or portion of a structure) after engagement. Panel B1 also shows two views of the anchor (220), a top-down view and a cutaway side view. As shown, the anchor in this embodiment has a port (222) with an opening in the upper surface (221) of the anchor (220). The lower portion of the port comprises a cavity bounded at the top by a flange (226) that has elements for retaining a locking device. A view of the bottom of a complementary locking device (230) is depicted in the upper portion of panel B2. A post (232) extends from the bottom of the locking device (230). When the anchor-engaging lock functionality of the locking device is in the locked position, two pins (234 and 236) are deployed from the post by mechanical linkages (not shown). When unlocked, the pins (234 and 236) are retracted into the post. To engage the anchor (220), the locking device (230) is positioned over the port (222) in the anchor (220) such that the post (232) can be inserted. The locking device is then lowered into the port to a depth sufficient to allow the pins (234 and 236) to be deployed. A sufficient depth can be achieved, for example, by lowering the locking device into the port such that the bottom face (238) of the post (232) contacts the surface (228) at the bottom of the port (222). When deployed in the port, the pins serve as anchor-engaging elements, and the flange (226) serves as a locking device-engaging element.

An alternative embodiment to that depicted in panels B1 and B2 of FIG. 13 involves a thin anchor (or structure) similar to that shown in panels A1 and A2 of the figure and a locking device similar to the one shown in panels B1 and B2. In such an embodiment, a bore extends through the anchor, and a post on the locking device is configured for insertion through the bore. When the locking device is positioned on the anchor (or structure), part of the post protrudes below the bottom surface of the anchor (or that portion of the structure adapted for insertion of a post-type element of a locking device according to the invention) such that anchor-engaging elements can then be deployed from the locking device in a manner analogous to the system employed in panels B1 and B2 of FIG. 13. As will be appreciated, in embodiments such as these and as illustrated in panels B1 and B2 of FIG. 13, once engaged the locking device may be rotated in relation to the anchor (and/or structure), but it cannot be withdrawn.

Those in the art will understand that the embodiments described above and in the attached figures represent only several of the multitude of embodiments of the lock systems, locking devices, anchors, and other components of the invention. As such, the figures do not limit, and assist in describing, the scope of the invention.

D. Applications

As described, anchors (or portions of structures adapted to serve as anchors) are used to secure (via detachable engagement) locking devices according to the invention to structures in order to prevent articles secured by the shackles of the devices from being stolen, lost, etc. Accordingly, the structures themselves should be of the sort that are not easily moved or misplaced. Examples of such structures include buildings, panels, vehicles, trees, large rocks, and the ground (e.g., sand and soil). The type of anchor employed and how it is attached to the structure will depend on a variety of factors, including the locking device used, the article(s) to be secured (including its size, value, etc.), the length of time the article is to be secured, the location and its accessibility to potential thieves, etc. As a result, the selection of anchors and locking devices is left to the discretion of the user.

If desired, more than one lock system according to the invention can be attached to the same structure. For example, a panel having a plurality of like anchors can be used to secure a plurality of different articles, wherein each article is secured to a locking device via its shackle and the locking device detachably engages one of the anchors. Similarly, a number of anchors can be secured to a structure such as a building. Articles, for example, tools, can then be secured to the building by detachably engaging locking devices to the anchors. The articles to be secured can be secured to the locking device before, at the same time as, or after the locking device is secured to the anchor.

Any article that can be secured by a shackle can be secured using a lock system according to the invention. Such articles include computers and other electronics, tools, helmets, and vehicles (e.g., automobiles, bicycles, motorcycles, water craft, aircraft, etc.). For example, a lock system can be used, for example, to secure tools (e.g., power saws and ladders) on a building construction site. Each tool may be secured by looping a flexible shackle cable through any suitable opening on the tool and attaching the shackle to a locking device according to the invention. The locking device can then be secured to an anchor that previously been fastened to the building, e.g., by screwing the anchor to an exposed framing stud.

Alternatively, an anchor as depicted in FIG. 9 can be used for securing articles to, for example, a motorcycle. In such embodiments, the anchor is either secured to the motorcycle's frame by replacing an existing bolt or by, for example, drilling and tapping a hole threaded to receive the threaded portion of the anchor's shank. A locking device according to the invention can then be used to secure, for example, a helmet, to the motorcycle by securing the helmet to the locking device via the shackle.

All of the locks, systems, and methods disclosed and claimed herein can be made and executed without undue experimentation in light of the present disclosure. While the locks, systems, and methods of this invention have been described in terms of preferred embodiments, it will be apparent to those of skill in the art that variations can be developed without undue effort in light of this specification and without departing from the concept, spirit and scope of the invention. More specifically, it will be apparent that certain components may be substituted for those described herein and will result in equivalents within the scope and meaning of the invention and this specification, including the appended claims. All such similar substitutes, modifications, and equivalents apparent are deemed to be within the spirit, scope, and concept of the invention as defined by the appended claims.

The invention illustratively described herein suitably may be practiced in the absence of any element(s) not specifically disclosed herein. Thus, for example, in each instance herein any of the terms "comprising", "consisting essentially of", and "consisting of" may be replaced with either of the other two terms. The terms and expressions which have been employed are used as terms of description and not of limitation, and there is no intention that in the use of such terms and expressions of excluding any equivalents of the features shown and described.

All patents and publications mentioned in the specification are indicative of the levels of those of ordinary skill in the art to which the invention pertains. All patents and publications are herein incorporated by reference to the same extent as if each individual publication was specifically and individually indicated to be incorporated by reference.

What is claimed is:

1. A locking device, comprising:

a. a lock capable of detachably engaging each of a shackle and an anchor secured to a structure, wherein the lock comprises a dual locking cylinder including a first retainer for engaging the shackle and a second retainer for engaging the anchor; and b. a lock body that houses and conceals the lock, wherein the lock body comprises a first port for insertion of the shackle for engagement by the first retainer of the lock and a second port for engaging a flange portion of the anchor, wherein the second port is configured to detachably and slidingly engage the flange portion and conceal at least a portion of anchor when the second retainer of the lock engages the anchor.

2. A locking device according to claim 1 further comprising a shackle adapted for insertion into the lock body and engagement by the first retainer of the lock.

3. A locking device according to claim 1 wherein the lock body further comprises a third port for accessing a portion of the lock to control whether the lock is locked or unlocked.

4. A locking device according to claim 1 wherein the lock is a key-actuated lock.

5. A locking device according to claim 1 wherein the lock is capable of simultaneous engagement of the shackle and the anchor.

6. A locking device according to claim 1 wherein the first retainer of the lock comprises a steel ball.

7. A locking device according to claim 6 wherein the second retainer engages an opening in the anchor.

8. A locking device according to claim 7 wherein the second retainer is selected from the group consisting of a bolt and a cam.

9. A locking device according to claim 1 wherein the lock body substantially conceals the anchor when the anchor is engaged by the lock.

10. A locking device according to claim 2 wherein the shackle comprises a flexible cable and two ends, each end being adapted for insertion into the lock body and engagement by the lock.

11. A lock system comprising a locking device according to claim 1 and an anchor comprising a flange configured for detachable, sliding engagement of the second port of the lock body.

12. A lock system according to claim 11 wherein the anchor is adapted for fixed attachment to a structure.

13. A lock system according to claim 11 wherein the flange comprises a first element configured to engage the second port of the lock body and a second element for engagement by the lock such that, when engaged by the lock, the locking device cannot be removed from the anchor.

14. A lock system according to claim 12 wherein the anchor is adapted for fixture to the structure by a fastener.

15. A lock system according to claim 14 wherein the fastener comprises a head and a threaded shank, and wherein the flange further comprises a bore sized to allow insertion of the threaded shank of the fastener through the bore for fixture of the flange to the structure.

16. A lock system according to claim 15 wherein the flange further comprises a recess for countersinking the head of the fastener.

17. A lock system according to claim 16 wherein the recess is disposed in the flange's upper surface and has a depth about equal to or greater than the height of the head of the fastener and a width greater than the width of the head of the fastener.

* * * * *